US011484092B2

(12) United States Patent
Goldston et al.

(10) Patent No.: US 11,484,092 B2
(45) Date of Patent: Nov. 1, 2022

(54) SHOES, DEVICES FOR SHOES, AND METHODS OF USING SHOES

(71) Applicant: Athletic Propulsion Labs LLC, Beverly Hills, CA (US)

(72) Inventors: Mark R. Goldston, Beverly Hills, CA (US); Ryan Goldston, Los Angeles, CA (US); Adam Goldston, Los Angeles, CA (US); Cody Harris, Pasadena, CA (US)

(73) Assignee: Athletic Propulsion Labs LLC, Beverly Hills, CA (US)

( * ) Notice: Subject to any disclaimer, the term of this patent is extended or adjusted under 35 U.S.C. 154(b) by 0 days.

(21) Appl. No.: 17/374,383

(22) Filed: Jul. 13, 2021

(65) Prior Publication Data

US 2022/0015502 A1 Jan. 20, 2022

Related U.S. Application Data

(60) Provisional application No. 63/052,382, filed on Jul. 15, 2020.

(51) Int. Cl.
*A43B 13/28* (2006.01)
*A43B 13/12* (2006.01)
(Continued)

(52) U.S. Cl.
CPC ..... *A43B 13/127* (2013.01); *A43B 13/026* (2013.01); *A43B 13/10* (2013.01);
(Continued)

(58) Field of Classification Search
CPC ..... A43B 13/182
See application file for complete search history.

(56) References Cited

U.S. PATENT DOCUMENTS 413,693 A 10/1889 Walker
507,490 A 10/1893 Gambino
(Continued)

FOREIGN PATENT DOCUMENTS

CN 2884963 4/2007
CN 200994449 12/2007
(Continued)

OTHER PUBLICATIONS

U.S. Non-Final Office Action dated Jul. 30, 2021, from U.S. Appl. No. 17/327,339.
(Continued)

*Primary Examiner* — Jila M Mohandesi
(74) *Attorney, Agent, or Firm* — Foley & Lardner LLP

(57) ABSTRACT

A shoe includes a first plate, a second plate, a third plate, filler material, springs, an insole, and a midsole. The first plate and the second plate are hingedly connected to each other. The filler material is located between the first plate and the second plate. The springs are located within openings in the filler material. The third plate is affixed to a top surface of the first plate. The insole is located above the third plate. The first plate is made of a thermoplastic elastomer, and the third plate is made of carbon fiber. Another shoe includes a midsole, a plate located above the midsole, springs located at least partially within openings in the midsole, and a spring holding unit located below the midsole for holding the springs. The spring holding unit includes spring holding members and branches connecting corresponding spring holding members.

30 Claims, 17 Drawing Sheets

(51) Int. Cl.

| | |
|---|---|
| ***A43B 13/18*** | (2006.01) |
| ***A43B 13/42*** | (2006.01) |
| ***A43B 13/10*** | (2006.01) |
| ***A43B 13/32*** | (2006.01) |
| ***A43B 13/02*** | (2022.01) |

(52) U.S. Cl.
CPC ..... *A43B 13/182* (2013.01); *A43B 13/32* (2013.01); *A43B 13/42* (2013.01)

(56) References Cited

U.S. PATENT DOCUMENTS 1,010,187 A 11/1911 Scott
1,069,001 A 7/1913 Guy
1,088,328 A 2/1914 Cucinotta
1,502,087 A 7/1924 Bunns
2,109,180 A 2/1938 Mohun
2,303,744 A 12/1942 Jacobs
2,357,281 A 8/1944 Williams
2,394,281 A 2/1946 Williams
2,437,227 A 3/1948 Hall
2,509,980 A 5/1950 McCallum
2,594,665 A 4/1952 Lockwood
2,682,712 A 7/1954 Owsen et al.
2,721,400 A 10/1955 Israel
2,766,901 A 10/1956 Sunko
3,120,712 A 2/1964 Menken
3,600,743 A 8/1971 Meadows
3,737,155 A 6/1973 Karlan
3,869,752 A 3/1975 Klay
4,016,662 A 4/1977 Thompson
4,364,188 A 12/1982 Turner et al.
4,457,084 A 7/1984 Horibata et al.
4,486,964 A 12/1984 Rudy
4,506,460 A 3/1985 Rudy
4,546,555 A 10/1985 Spademan
4,592,153 A 6/1986 Jacinto
4,603,452 A 8/1986 Paciorek
4,709,489 A 12/1987 Welter
4,771,554 A 9/1988 Hannemann
4,815,221 A 3/1989 Diaz
4,844,519 A 7/1989 Dagon
4,854,057 A 8/1989 Misevich et al.
4,878,300 A 11/1989 Bogaty
4,894,934 A 1/1990 Illustrato
4,901,987 A 2/1990 Greenhill et al.
5,060,401 A 10/1991 Whatley
5,092,060 A 3/1992 Frachey et al.
5,159,767 A 11/1992 Allen
5,203,095 A 4/1993 Allen
5,224,278 A 7/1993 Jeon
5,279,051 A 1/1994 Whatley
5,282,325 A 2/1994 Beyl
5,325,611 A 7/1994 Dyer et al.
5,343,639 A 9/1994 Kilgore et al.
D355,755 S 2/1995 Kilgore
5,435,079 A 7/1995 Gallegos
5,437,110 A 8/1995 Goldston et al.
5,464,197 A 11/1995 Ecclesfield
5,502,901 A 4/1996 Brown
5,513,448 A 5/1996 Lyons
5,572,804 A 11/1996 Skaja et al.
5,588,227 A 12/1996 Goldston et al.
5,596,819 A 1/1997 Goldston et al.
5,622,358 A 4/1997 Komura et al.
5,649,373 A 7/1997 Winter et al.
5,651,196 A 7/1997 Hsieh
5,671,552 A 9/1997 Pettibone et al.
5,706,589 A 1/1998 Marc
5,743,028 A 4/1998 Lombardino
5,845,419 A 12/1998 Begg
5,875,567 A 3/1999 Bayley
5,896,679 A 4/1999 Baldwin
5,983,529 A 11/1999 Serna
6,006,449 A 12/1999 Orlowski et al.
6,029,374 A 2/2000 Herr et al.
6,029,962 A 2/2000 Shorten et al.
6,041,478 A 3/2000 Martin
6,055,747 A 5/2000 Lombardino
D433,216 S 11/2000 Avar et al.
6,282,814 B1 9/2001 Krafsur et al.
6,336,249 B1 1/2002 Plumley
6,393,731 B1 5/2002 Moua et al.
6,457,261 B1 10/2002 Crary
6,530,564 B1 3/2003 Julien
6,546,648 B2 4/2003 Dixon
6,562,427 B2 5/2003 Hung
6,568,102 B1 * 5/2003 Healy ..... A43B 13/187 36/27
6,662,472 B1 12/2003 Hsu
6,665,957 B2 12/2003 Levert et al.
6,730,379 B2 5/2004 Bonk et al.
6,751,891 B2 * 6/2004 Lombardino ..... A43B 13/182 36/142
6,860,034 B2 3/2005 Schmid
6,865,824 B2 3/2005 Levert et al.
6,886,274 B2 5/2005 Krafsur et al.
D507,094 S 7/2005 Lyden
6,920,705 B2 * 7/2005 Lucas ..... A43B 3/0063 36/142
6,928,756 B1 8/2005 Haynes
6,944,972 B2 9/2005 Schmid
6,983,553 B2 1/2006 Lussier et al.
7,100,308 B2 9/2006 Aveni
7,140,125 B2 11/2006 Singleton et al.
7,155,844 B2 1/2007 Chu
7,159,338 B2 1/2007 Levert et al.
7,171,765 B2 * 2/2007 Lo ..... A43B 13/203 36/29
D538,018 S 3/2007 Hlavacs
7,219,447 B2 5/2007 Levert et al.
7,287,340 B2 10/2007 Talbott
7,290,354 B2 11/2007 Perenich
7,418,790 B2 9/2008 Kerrigan
7,441,347 B2 10/2008 Levert et al.
7,600,330 B2 10/2009 Chen
7,900,376 B2 3/2011 Rabushka
7,950,166 B1 5/2011 Perenich
8,112,905 B2 2/2012 Bemis et al.
8,347,526 B2 1/2013 Goldston et al.
8,495,825 B2 * 7/2013 Goldston ..... A43B 13/16 36/27
8,621,766 B2 * 1/2014 Goldston ..... A43B 13/181 36/27
8,732,983 B2 * 5/2014 Goldston ..... A43B 13/181 36/27
9,044,064 B2 6/2015 Baucom et al.
9,194,166 B1 11/2015 Spiegel et al.
9,370,221 B1 6/2016 Hsu et al.
9,414,642 B2 8/2016 Berend et al.
10,045,588 B2 8/2018 Berend et al.
10,687,583 B2 6/2020 Yoshida et al.
10,959,487 B2 * 3/2021 Brown ..... A43B 21/30
11,134,738 B2 10/2021 Grice
2001/0049888 A1 12/2001 Krafsur et al.
2002/0073579 A1 6/2002 Lombardino
2002/0133976 A1 9/2002 Crutcher
2002/0144430 A1 10/2002 Schmid
2002/0174567 A1 11/2002 Krafsur et al.
2002/0189134 A1 12/2002 Dixon
2003/0051372 A1 3/2003 Lyden
2003/0104164 A1 6/2003 Wu
2003/0126760 A1 7/2003 Levert et al.
2003/0163933 A1 9/2003 Krafsur et al.
2003/0192200 A1 10/2003 Dixon
2003/0200677 A1 10/2003 Abraham
2003/0217483 A1 11/2003 Abraham
2004/0021123 A1 2/2004 Howell et al.
2004/0118017 A1 6/2004 Dalton et al.
2004/0154191 A1 8/2004 Park
2004/0237340 A1 12/2004 Rembrandt
2005/0081401 A1 4/2005 Singleton et al.
2005/0126039 A1 6/2005 Levert et al.
2005/0138839 A1 6/2005 Terlizzi et al.

(56) References Cited

U.S. PATENT DOCUMENTS

| | | | | |
|---|---|---|---|---|
| 2005/0166422 | A1 | 8/2005 | Schaeffer et al. | |
| 2005/0193595 | A1 | 9/2005 | Jennings | |
| 2005/0241184 | A1 | 11/2005 | Levert et al. | |
| 2005/0247385 | A1 | 11/2005 | Krafsur et al. | |
| 2006/0021259 | A1 | 2/2006 | Wood et al. | |
| 2006/0048412 | A1 | 3/2006 | Kerrigan | |
| 2006/0065499 | A1 | 3/2006 | Smaldone et al. | |
| 2006/0075657 | A1 | 4/2006 | Chu | |
| 2006/0096125 | A1 | 5/2006 | Yen | |
| 2006/0130371 | A1 | 6/2006 | Schneider | |
| 2006/0277788 | A1 | 12/2006 | Fujii | |
| 2007/0039204 | A1 | 2/2007 | Wyszynski et al. | |
| 2007/0209232 | A1 | 9/2007 | Chen | |
| 2008/0098619 | A1 | 5/2008 | Smaldone et al. | |
| 2008/0184596 | A1 | 8/2008 | Yu | |
| 2008/0209762 | A1 | 9/2008 | Krafsur | |
| 2008/0263894 | A1 | 10/2008 | Nakano | |
| 2008/0263899 | A1 | 10/2008 | Lee | |
| 2008/0271340 | A1 | 11/2008 | Grisoni et al. | |
| 2008/0313928 | A1 | 12/2008 | Adams et al. | |
| 2009/0056165 | A1 | 3/2009 | Lee | |
| 2009/0064536 | A1 | 3/2009 | Klassen et al. | |
| 2009/0100716 | A1 | 4/2009 | Gerber | |
| 2009/0113760 | A1 | 5/2009 | Dominguez | |
| 2009/0282704 | A1 | 11/2009 | Park | |
| 2010/0251571 | A1 | 10/2010 | Woodard | |
| 2010/0257752 | A1 | 10/2010 | Goldston et al. | |
| 2010/0257753 | A1 | 10/2010 | Bemis et al. | |
| 2011/0005100 | A1 | 1/2011 | Smaldone et al. | |
| 2011/0314695 | A1 | 12/2011 | Tsai | |
| 2012/0023784 | A1* | 2/2012 | Goldston | A43B 7/1445 36/137 |
| 2012/0025576 | A1 | 2/2012 | Stern et al. | |
| 2012/0110871 | A1 | 5/2012 | Elnekaveh | |
| 2012/0144695 | A1 | 6/2012 | Mcdowell et al. | |
| 2012/0204442 | A1 | 8/2012 | Elnekaveh | |
| 2012/0318574 | A1 | 12/2012 | Beer et al. | |
| 2013/0091735 | A1 | 4/2013 | Goldston et al. | |
| 2013/0118028 | A1 | 5/2013 | Yoon | |
| 2013/0263471 | A1 | 10/2013 | Spinks | |
| 2015/0167768 | A1 | 6/2015 | Zhao | |
| 2015/0181977 | A1 | 7/2015 | Klug et al. | |
| 2018/0199663 | A1* | 7/2018 | Dhanjal | A43B 3/128 |
| 2021/0212892 | A1 | 7/2021 | Seo | |

FOREIGN PATENT DOCUMENTS

| | | | |
|---|---|---|---|
| EP | 0 552 994 | B1 | 7/1993 |
| EP | 1 346 655 | B1 | 9/2003 |
| JP | 2011-036394 | A | 2/2011 |
| WO | WO-99/38405 | A1 | 8/1999 |

OTHER PUBLICATIONS

International Preliminary Report on Patentability for PCT patent application No. PCT/US2010/030012 dated Oct. 11, 2011.
International Search Report and Written Opinion dated Jul. 27, 2010, from application No. PCT/US2010/030012.
Notice of Allowance and Fee(s) Due for U.S. Appl. No. 13/341,267 dated Jun. 14, 2013.
Notice of Allowance and Fee(s) Due issued for U.S. Appl. No. 12/467,679 and dated Nov. 14, 2011.
Notice of Allowance dated Oct. 21, 2013 for U.S. Appl. No. 13/708,883.
Office Action dated May 29, 2013 in Taiwan Application No. 099110809.
Office Action dated Jul. 31, 2013 in U.S. Appl. No. 13/708,883.
Translation of Office Action for Taiwan Application No. 099110809.
U.S. Office Action for U.S. Appl. No. 12/754,333, dated Oct. 25, 2012.
U.S. Office Action for U.S. Appl. No. 12/754,333 dated Jun. 29, 2012.
U.S. Office Action dated Mar. 3, 2014 for U.S. Appl. No. 13/270,153.
U.S. Office Action dated Mar. 4, 2014 for U.S. Appl. No. 14/095,941.
U.S. Final Office Action dated May 7, 2020, from U.S. Appl. No. 16/126,758.
U.S. Non-Final Office Action dated Feb. 14, 2020, from U.S. Appl. No. 16/126,758.
U.S. Non-Final Office Action dated Sep. 14, 2020, from U.S. Appl. No. 16/126,758.
U.S. Notice of Allowance dated Apr. 2, 2014, from U.S. Appl. No. 13/270,153.
U.S. Notice of Allowance dated Apr. 9, 2014, from U.S. Appl. No. 14/095,941.
U.S. Notice of Allowance dated Feb. 23, 2021, from U.S. Appl. No. 16/126,758.
U.S. Notice of Allowance dated Jun. 1, 2018, from U.S. Appl. No. 14/271,197.
U.S. Notice of Allowance dated Mar. 28, 2016, from related U.S. Appl. No. 14/095,950.
U.S. Notice of Allowance dated Nov. 23, 2012, from U.S. Appl. No. 12/754,333.
U.S. Office Action dated Feb. 22, 2013, from U.S. Appl. No. 13/341,267.
U.S. Office Action dated Dec. 22, 2017, from U.S. Appl. No. 14/271,197.
U.S. Office Action dated Jan. 31, 2017, from U.S. Appl. No. 14/271,197.
U.S. Office Action dated Nov. 20, 2015, from U.S. Appl. No. 14/095,950.
U.S. Office Action dated Sep. 6, 2017, from U.S. Appl. No. 14/271,197.
U.S. Office Action dated Sep. 7, 2011, from U.S. Appl. No. 12/467,679.
U.S. Notice of Allowance dated Nov. 12, 2021, from U.S. Appl. No. 17/327,339.
International Search Report and Written Opinion dated Jan. 18, 2022, from application No. PCT/US2021/055449, 11 pages.
U.S. Non-Final Office Action dated Feb. 28, 2022, from U.S. Appl. No. 17/503,793.
U.S. Non-Final Office Action dated May 2, 2022, from U.S. Appl. No. 17/553,556.
U.S. Final Office Action dated Aug. 10, 2022, from U.S. Appl. No. 17/553,556.

* cited by examiner

SHOES, DEVICES FOR SHOES, AND METHODS OF USING SHOES

CROSS-REFERENCE TO RELATED PATENT APPLICATIONS

This application claims priority from U.S. Provisional Patent App. Ser. No. 63/052,382, filed Jul. 15, 2020, the entire contents of which are incorporated by reference herein.

FIELD

Embodiments of the present invention relate in general to footwear, and particularly to energy absorption and return systems for use in footwear.

BACKGROUND

In prior U.S. Pat. No. 10,085,514, filed May 6, 2014, by Goldston et al., a discussion was provided of the desirability of providing for energy shock absorption and energy return by shoes. The entire contents of U.S. Pat. No. 10,085,514 are incorporated by reference herein.

SUMMARY OF THE DISCLOSURE

A shoe in accordance with an embodiment includes a first plate and a second plate that are hingedly connected to each other, a third plate affixed to a top surface of the first plate, an insole located on a top surface of the third plate, and a midsole. The second plate is located within an opening in the midsole. The third plate is longer than the first plate and is positioned such that a back portion of the third plate extends farther back than a back end of the first plate and such that a front portion of the third plate extends farther forward than a front end of the first plate.

In various embodiments, the first plate is made of a thermoplastic elastomer, and the third plate is made of a carbon fiber. In various embodiments, the insole is made of an ethylene-vinyl acetate material. In some embodiments, the first plate is made of titanium, and the third plate is made of carbon fiber. In various embodiments, the third plate has a shorter length than a length of the insole.

In various embodiments, the third plate extends within an area bounded by a first wall of the midsole at a back of the shoe to a second wall of the midsole at a front of the shoe. In some embodiments, the first plate is longer than the second plate such that the first plate extends farther both forward and backward in the shoe than the second plate. In some embodiments, the third plate is glued to the first plate. Also, in some embodiments, an entirety of the top surface of the first plate is glued to a bottom surface of the third plate.

In various embodiments, the first plate includes a hinge portion that extends from a bottom surface of the first plate and is integrally formed with the bottom surface of the first plate. Also, in various embodiments, the hinge portion of the first plate extends from the bottom surface of the first plate at a location that is positioned a certain distance inward from a rear end of the first plate. In some embodiments, a hinge portion of the second plate extends from a back end of the second plate and is integrally formed with the back end of the second plate, and a pin extends through the hinge portion of the first plate and the hinge portion of the second plate. In some embodiments, the hinge portion of the first plate extends from the bottom surface of the first plate at a location that is positioned more than one centimeter inward from a back end of the first plate.

In various embodiments, the shoe further includes filler material located between the first plate and the second plate and springs located within openings in the filler material. In various embodiments, the second plate and the filler material are shorter in length than a length of the first plate such that there is a front portion of the first plate that extends farther forward than a front end of the second plate and a front end of the filler material.

In various embodiments, the midsole includes a back portion of the midsole that is located farther back in the shoe than the opening in the midsole, and the midsole also includes a front portion of the midsole that is located farther forward in the shoe than the opening in the midsole. In various embodiments, the back portion of the midsole includes a first surface of the back portion of the midsole, a second surface of the back portion of the midsole, and a third surface of the back portion of the midsole, and the front portion of the midsole includes a first surface of the front portion of the midsole and a second surface of the front portion of the midsole. In some embodiments, the first surface of the back portion of the midsole is higher in the shoe than the second surface of the back portion of the midsole such that there is a step down from the first surface of the back portion of the midsole to the second surface of the back portion of the midsole. In some embodiments, the second surface of the back portion of the midsole is higher in the shoe than the third surface of the back portion of the midsole such that there is a step down from the second surface of the back portion of the midsole to the third surface of the back portion of the midsole. Also, in some embodiments, the first surface of the front portion of the midsole is higher in the shoe than the second surface of the front portion of the midsole such that there is a step down from the first surface of the front portion of the midsole to the second surface of the front portion of the midsole.

In various embodiments, the back portion of the midsole and the front portion of the midsole are located on an outsole, the second plate is located on the outsole and within the opening in the midsole, a back portion of the insole is located on the first surface of the back portion of the midsole, a back portion of the third plate is located on the second surface of the back portion of the midsole, a back portion of the first plate is located on the third surface of the back portion of the midsole, a front portion of the insole is located on the first surface of the front portion of the midsole, and a front portion of the third plate is located on the second surface of the front portion of the midsole.

A method in accordance with an embodiment allows for storing and returning energy to a foot of a human by a shoe. The shoe includes a first plate and a second plate that are hingedly connected to each other, springs located between the first plate and the second plate, a third plate affixed to a top surface of the first plate, and an insole located on a top surface of the third plate. The third plate is longer than the first plate and is positioned such that a back portion of the third plate extends farther back than a back end of the first plate and such that a front portion of the third plate extends farther forward than a front end of the first plate. The method includes applying, with the foot, a force on the third plate that is affixed to the first plate by pressing on the insole so as to cause the first plate to move toward the second plate to compress the springs, and launching the foot due to the first plate being pushed by the springs to cause the third plate affixed to the first plate to return energy to the foot as the foot is being lifted. In various embodiments, the first plate is made of a thermoplastic elastomer, and the third plate is made of carbon fiber. In various embodiments, the third plate is glued to the first plate.

A shoe in accordance with another embodiment includes a midsole having a plurality of openings, a plate located above the midsole, a plurality of springs, and a spring holding unit. Each spring of the plurality of springs is located at least partially within a corresponding opening of the plurality of openings in the midsole. The spring holding unit is located below the midsole. The spring holding unit includes a plurality of spring holding members that each hold a corresponding spring of the plurality of springs, and further includes a plurality of branches where each branch of the plurality of branches connects corresponding spring holding members of the plurality of spring holding members. In various embodiments, each spring holding member of the plurality of spring holding members is circular, and a width of each branch of the plurality of branches is smaller than a diameter of each of the corresponding spring holding members to which the branch is connected.

In various embodiments, the shoe further includes an insole that is located above the plate. In some embodiments, the plate is shorter in length than a length of the insole such that a front portion of the insole extends farther forward than a front end of the plate and such that a back portion of the insole extends farther back than a back end of the plate. Also, in some embodiments, the insole is made of an ethylene-vinyl acetate material. In various embodiments, the plate is made of carbon fiber. In various embodiments, the plate extends within an area bounded by a first wall of the midsole at a back of the shoe to a second wall of the midsole at a front of the shoe.

In various embodiments, the plurality of openings in the midsole are in a pattern to match a layout of the spring holding unit such that each spring holding member of the plurality of spring holding members of the spring holding unit aligns with the corresponding spring of the plurality of springs that is at least partially within the corresponding opening of the plurality of openings of the midsole. In various embodiments, the spring holding unit is made of a polycarbonate, styrene, thermoplastic polyurethane, a thermoplastic elastomer, poly-paraphenylene terephthalamide, or carbon fiber.

In some embodiments, each branch of the plurality of branches is made of a material that is flexible. In some embodiments, the spring holding unit is configured such that each branch of the plurality of branches is independently flexible from the other branches of the plurality of branches. In some embodiments, each branch of the plurality of branches is made of a material that is rigid. In various embodiments, each spring holding member of the plurality of spring holding members includes a surface on which the corresponding spring of the plurality of springs sits, and includes a wall around the surface to surround at least a portion of the corresponding spring that is on the spring holding member.

In various embodiments, the shoe further includes an outsole, and the spring holding unit is located on the outsole. In some embodiments, the shoe includes an insole, the plate is under the insole and extends over a first top surface a front portion of the midsole, the front portion of the midsole further includes a second top surface in front of the first top surface that is higher than the first top surface, and a front portion of the insole is located on the second top surface. In various embodiments, the plurality of spring holding members includes at least three spring holding members, and the plurality of branches includes at least three branches.

A method in accordance with an embodiment allows for storing and returning energy to a foot of a human by a shoe. The shoe includes a midsole having a plurality of openings, a plate located above the midsole, a plurality of springs where each spring of the plurality of springs is located at least partially within a corresponding opening of the plurality of openings in the midsole, and a spring holding unit located below the midsole where the spring holding unit includes a plurality of spring holding members that each hold a corresponding spring of the plurality of springs, and the spring holding unit also includes a plurality of branches where each branch of the plurality of branches connects corresponding spring holding members of the plurality of spring holding members. The method includes applying, with the foot, a force on the plate so as to move the plate toward the plurality of spring holding members to cause the plurality of springs to compress, and launching the foot due to the plate being moved apart from the plurality of spring holding members by the springs to cause the plate to return energy to the foot as the foot is being lifted. In some embodiments, the method further includes flexing at least one branch of the plurality of branches when the human steps on an uneven surface with the shoe.

DETAILED DESCRIPTION

Figure 1:
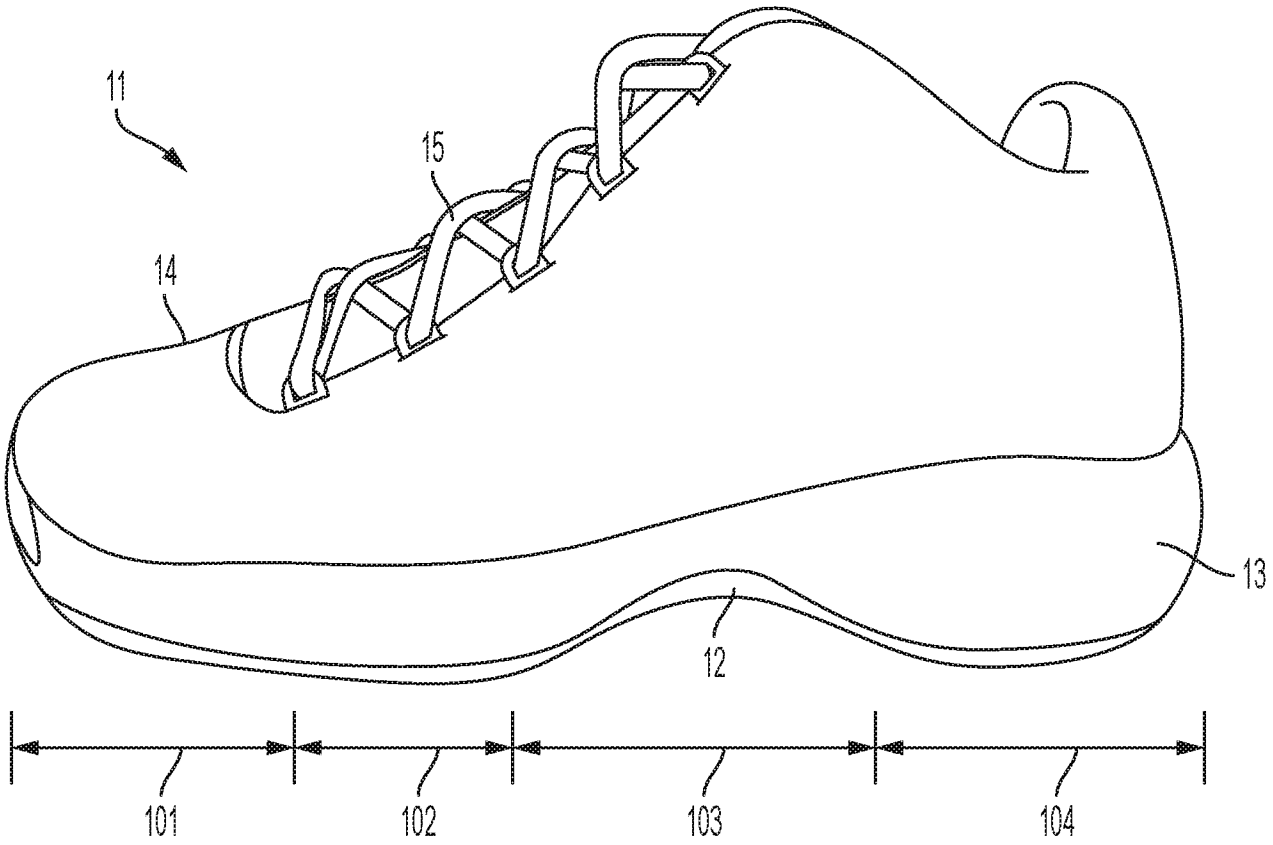
FIG. 1 shows a shoe in accordance with an embodiment.

FIG. 1 shows a shoe 11 in accordance with an embodiment. The shoe 11 includes an outsole 12, a midsole 13, an upper 14, and a fastening member 15. The shoe 11 has various portions, including a forefoot portion 101, a ball portion 102, an arch portion 103, and a heel portion 104. The outsole 12 is designed to be placed on the ground in normal operation of the shoe 11. The upper 14 includes an opening for a foot and means for tightening the shoe 11 around the foot, such as the fastening member 15, which may be, for example, laces, a zipper, or the like.

The forefoot portion 101 of the shoe 11 is located at the front of the shoe 11, and the forefoot portion 101 may support the toes of a foot when the foot is inserted into the shoe 11. The ball portion 102 is located adjacent to the forefoot portion 101, and the ball portion 102 may support the ball of a foot when the foot is inserted into the shoe 11. The arch portion 103 is located adjacent to the ball portion 102, and may provide support to an arch of a foot when the foot is inserted into the shoe 11. The heel portion 104 is located adjacent to the arch portion 103 and at the rear of the shoe, and may provide support to a heel of a foot when the foot is inserted into the shoe 11.

Figure 2:
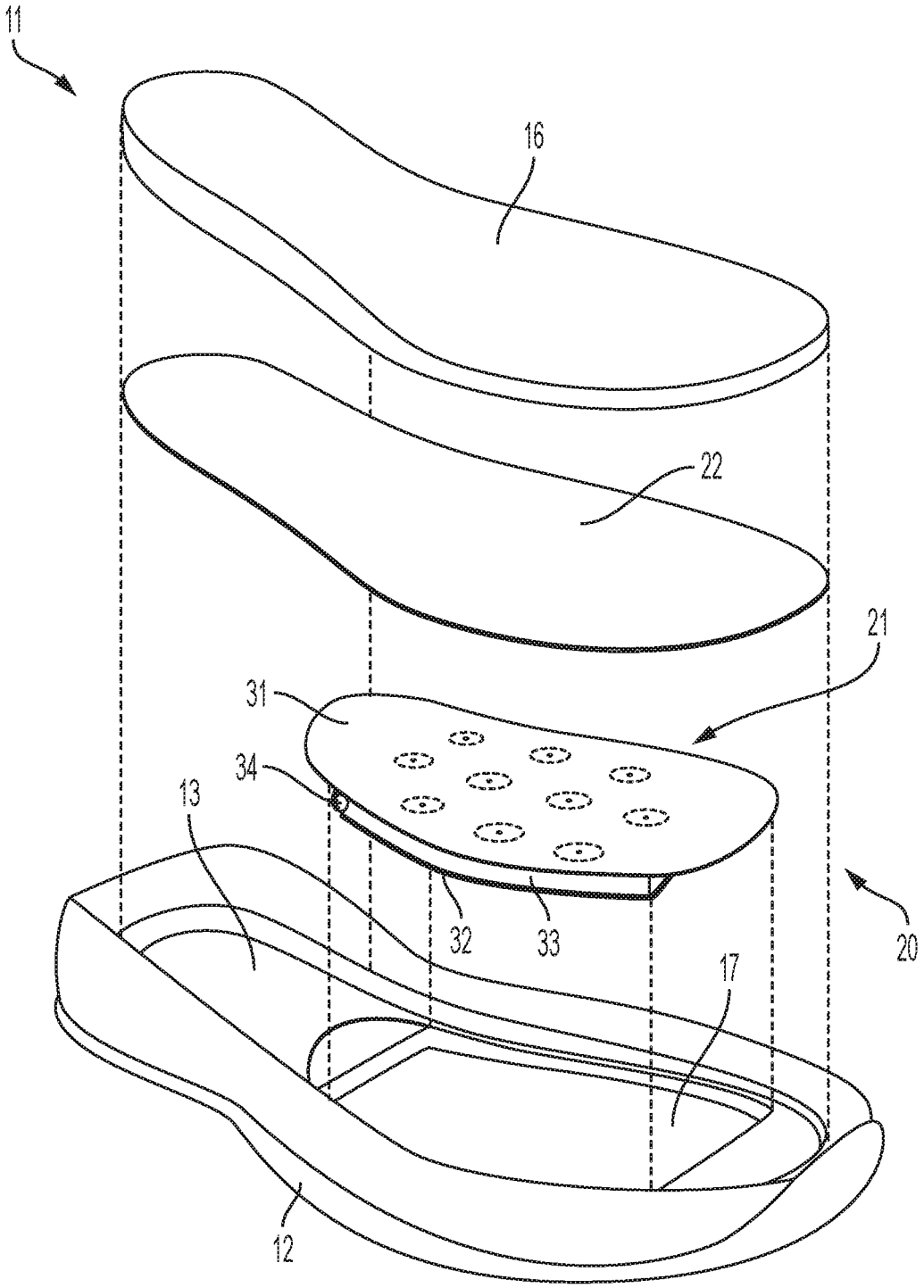
FIG. 2 shows an exploded view of a portion of the shoe of FIG. 1 including a device in accordance with an embodiment.

FIG. 2 shows an exploded view of a portion of the shoe 11 in accordance with an embodiment. The shoe 11 includes the outsole 12, the midsole 13, an insole 16, and a device 20. The device 20 includes a device 21 and a plate 22. The device 21 includes a first plate 31, a second plate 32, filler material 33, and a pin 34. The first plate 31 is hinged together with the second plate 32 by the pin 34. The filler material 33 is located between the first plate 31 and the second plate 32. The plate 22 is located above the first plate 31. The insole 16 is located above the plate 22. There is a cavity or opening 17 in the midsole 13 into which at least a portion of the device 21 is insertable. For example, the second plate 32 may be positioned within the opening 17 in the midsole 13 such that a bottom surface of the second plate 32 could contact a top surface of the outsole 12. Referring to FIGS. 1 and 2, the shoe 11 can have other elements such as the upper 14 and the fastening member 15.

In various embodiments, the plate 22 is a carbon fiber plate. Also, in various embodiments, the plate 22 has a same or similar shape as the insole 16 in length and width directions. In some embodiments, the plate 22 has a shorter length than the insole 16. In various embodiments, the plate 22 extends across substantially an entire length of the shoe 11. For example, in some embodiments, the plate 22 extends within an area bounded by a wall of the midsole 13 at the back of the shoe 11 to a wall of the midsole 13 at the front of the shoe 11. In various embodiments, the plate 22 extends from the heel portion 104 of the shoe 11 and through the arch portion 103 and ball portion 102 of the shoe 11 and into the forefoot portion 101 of the shoe 11. In some embodiments, there is a sockliner positioned above the insole 16 that is on an opposite side of the insole 16 from the plate 22. In various embodiments, the insole 16 comprises an ethylene-vinyl acetate (EVA) material, or the like.

In various embodiments, the first and second plates 31 and 32 comprise a thermoplastic elastomer such as a polyether block amide (PEBA) material, such as the PEBA material known as Pebax® that is manufactured by ARKEMA. In various other embodiments, the first and second plates 31 and 32 comprise other materials, such as metals like titanium, or the like. The first plate 31 is hinged together with the second plate 32 by the pin 34 such that the first plate 31 is rotatable about the pin 34. In various embodiments, a rear end of the first plate 31 is positioned near a half-way point of a length of the shoe 11 and extends all the way to near a front of the shoe 11 where it would be under the toes of a user of the shoe 11. In various embodiments, the first plate 31 extends from a position in the arch portion 103 of the shoe 11 and through the ball portion 102 of the shoe 11 and into the forefoot portion 101 of the shoe 11 to near a front of the forefoot portion 101 of the shoe 11. In various embodiments, the first plate 31 is longer than the second plate 32 such that the first plate 31 extends farther both forward and backward in the shoe 11 than the second plate 32. In various embodiments, the plate 22 is longer than the first plate 31 such that the plate 22 extends farther both forward and backward in the shoe 11 than the first plate 31.

In various embodiments, the plate 22 is glued or otherwise affixed to the first plate 31. For example, an entire top surface of the first plate 31 in various embodiments is glued to a bottom surface of the plate 22 during manufacture. In various embodiments, the plate 22 is a carbon fiber plate and the first plate 31 is a thermoplastic elastomer plate such as a polyether block amide plate, and the first plate 31 is glued to the plate 22. In various embodiments, the plate 22 is affixed, such as being permanently affixed, to the device 21 such that the plate 22 works together with the device 21 to provide energy return to a user using the shoe 11. In various embodiments, the plate 22 is affixed to the first plate 31 of the device 21 such that an energy return of the plate 22 works with a kinetic release of the device 21 when a user is using the shoe 11.

Figure 3:
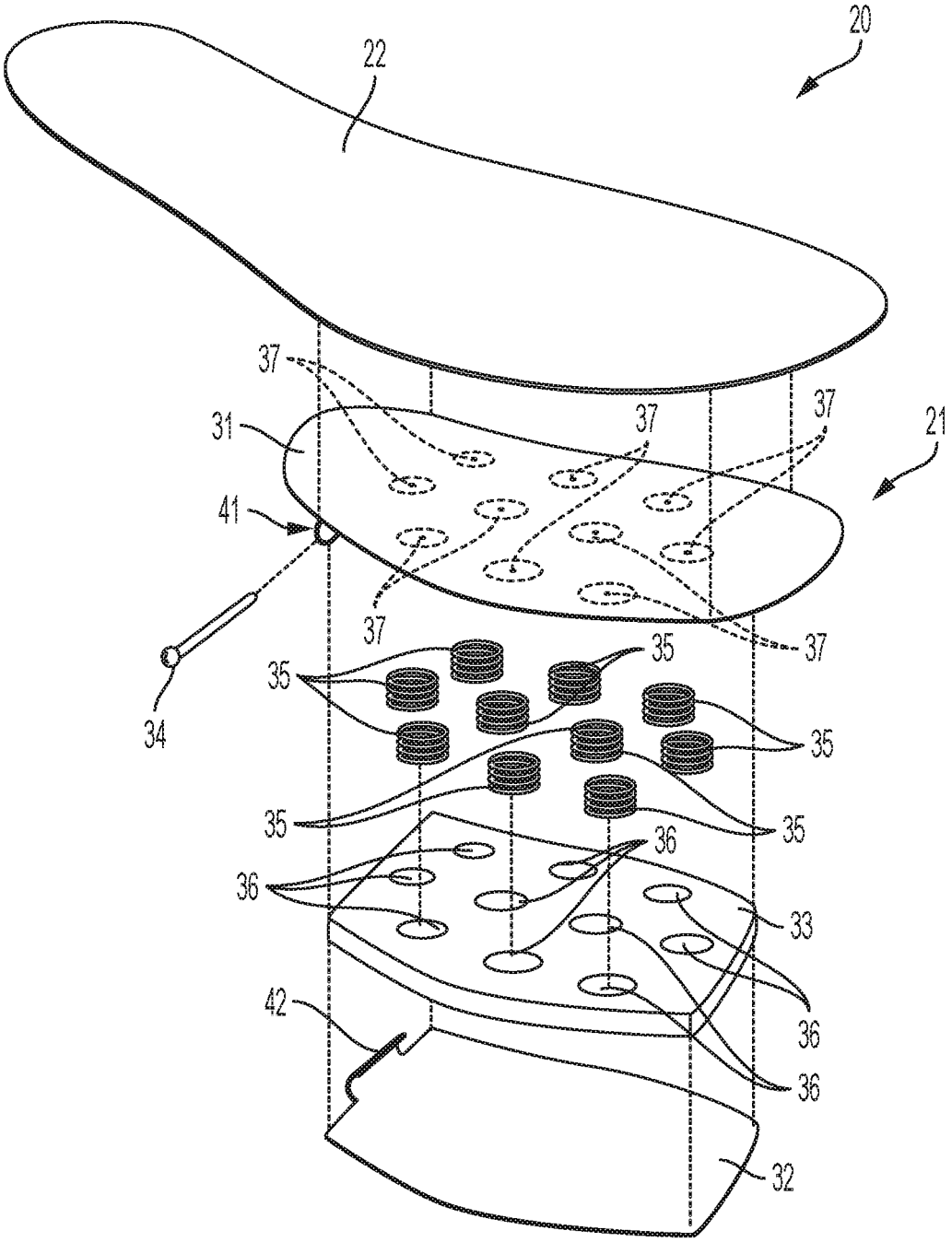
FIG. 3 shows an exploded view of the device from FIG. 2 for use in a shoe in accordance with an embodiment.

FIG. 3 shows an exploded view of the device 20 from FIG. 2 for use in a shoe in accordance with an embodiment. The device 20 includes the device 21 and the plate 22. The device 21 includes the first plate 31, the second plate 32, the filler material 33, and the pin 34. The device 21 further includes one or more springs 35. There can be any number of springs 35 in various embodiments, and the embodiment shown in FIG. 3 includes 10 springs. Other embodiments may include, for example, 1, 2, 3, 4, 5, 6, 7, 8, 9, or more than 10 springs. There are openings 36 in the filler material 33 for accommodating the springs 35 between the first plate 31 and the second plate 32. Each of the springs 35 is positionable is a corresponding one of the openings 36 in the filler material 33 between the first plate 31 and the second plate 32.

The first plate 31 includes a hinge portion 41 that extends from a bottom surface of the first plate 31 and in various embodiments is integrally formed with the bottom surface of the first plate 31. The hinge portion 41 of the first plate 31 is in a curved shape such that it is curved around the pin 34 when the pin 34 is positioned within the hinge portion 41 of the first plate 31. In various embodiments, the hinge portion 41 extends from the bottom surface of the first plate 31 at a location that is positioned a certain distance inward from a rear end of the first plate 31 such that the hinge portion 41 is not at the very back end of the first plate 31. In various embodiments, the hinge portion 41 extends from the bottom surface of the first plate 31 at a location that is positioned more than a centimeter inward from a back end of the first plate 31.

The second plate 32 includes a hinge portion 42. The hinge portion 42 of the second plate 32 extends from a back end of the second plate 32 and in various embodiments is integrally formed with the back end of the second plate 32. The hinge portion 42 of the second plate 32 is in a curved shape such that it is curved around the pin 34 when the pin 34 is positioned within the hinge portion 42 of the second plate 32. The hinge portion 42 of the second plate 42 extends upward toward the bottom surface of the first plate 31. The pin 34 is insertable through the hinge portion 41 of the first plate 31 and through the hinge portion 42 of the second plate 32 to cause the first plate 31 to be hingedly connected to the second plate 32 by the hinge portion 41 of the first plate 31, the hinge portion 42 of the second plate 32, and the pin 34.

In various embodiments, there are openings 37 in the first plate 31 to allow for air to escape from the device 21. For example the openings 37 may pass from a top surface of the first plate 31 to the bottom surface of the first plate 31. In various embodiments each of the openings 37 is aligned to be centered with a corresponding one of the springs 35 and over a center of a corresponding one of the openings 36 in the filler material 33. The springs 35 and the filler material 33 are compressible when the first plate 31 is rotated toward the second plate 32 about a hinge provided by the hinge portion 41 of the first plate 31, the hinge portion 42 of the second plate 32, and the pin 34. Thus, the first plate 31 is rotatable toward the second plate 32 about the pin 34. When the springs 35 and the filler material 33 are compressed by movement of the first plate 31, air can escape from the openings 36 in the filler material 33 through the openings 37 in the first plate 31. The openings 37 allow air to pass through the first plate 31, such that when the device 21 is compressed, air pressure is released. In various embodiments, the plate 22 is glued or otherwise affixed to the top surface of the first plate 31 in a manner in which air is still able to escape from between the plate 22 and the first plate 31.

The springs 35 are located between the first plate 31 and the second plate 32 to provide a bias force that separates the first plate 31 and second plate 32 from each other and can be compressed when the plate 22 is stepped on by a user to cause the first plate 31 to rotate toward the second plate 32. The springs 35 act as energy return members to store energy when compressed and then release the energy to launch a foot of a user. In various embodiments, the springs 35 are compression springs. In some embodiments, the springs 35 are wave springs. In some embodiments, some of the springs 35 are compression springs while other of the springs 35 are wave springs.

In various embodiments, the filler material 33 comprises ethylene vinyl acetate (EVA), or the like. In some embodiments, the openings 36 are die-cut holes in the filler material 33. In some embodiments, the filler material 33 is formed to have the openings 36. The diameters of the openings 36 may individually vary in size depending on the diameters of springs 35 to be placed in the openings 36. For example, each of the openings 36 in the filler material 33 may have a diameter that is slightly larger than a diameter of the corresponding spring 35 to be placed in the opening 36. The filler material 33 is compressible between the first plate 31 and the second plate 32 when a user steps on the plate 22 to cause the first plate 31 to rotate toward the second plate 32, and then the filler material 33 is expandable from a compressed state to return back as the first plate 31 rotates away from the second plate 32.

Figure 4:
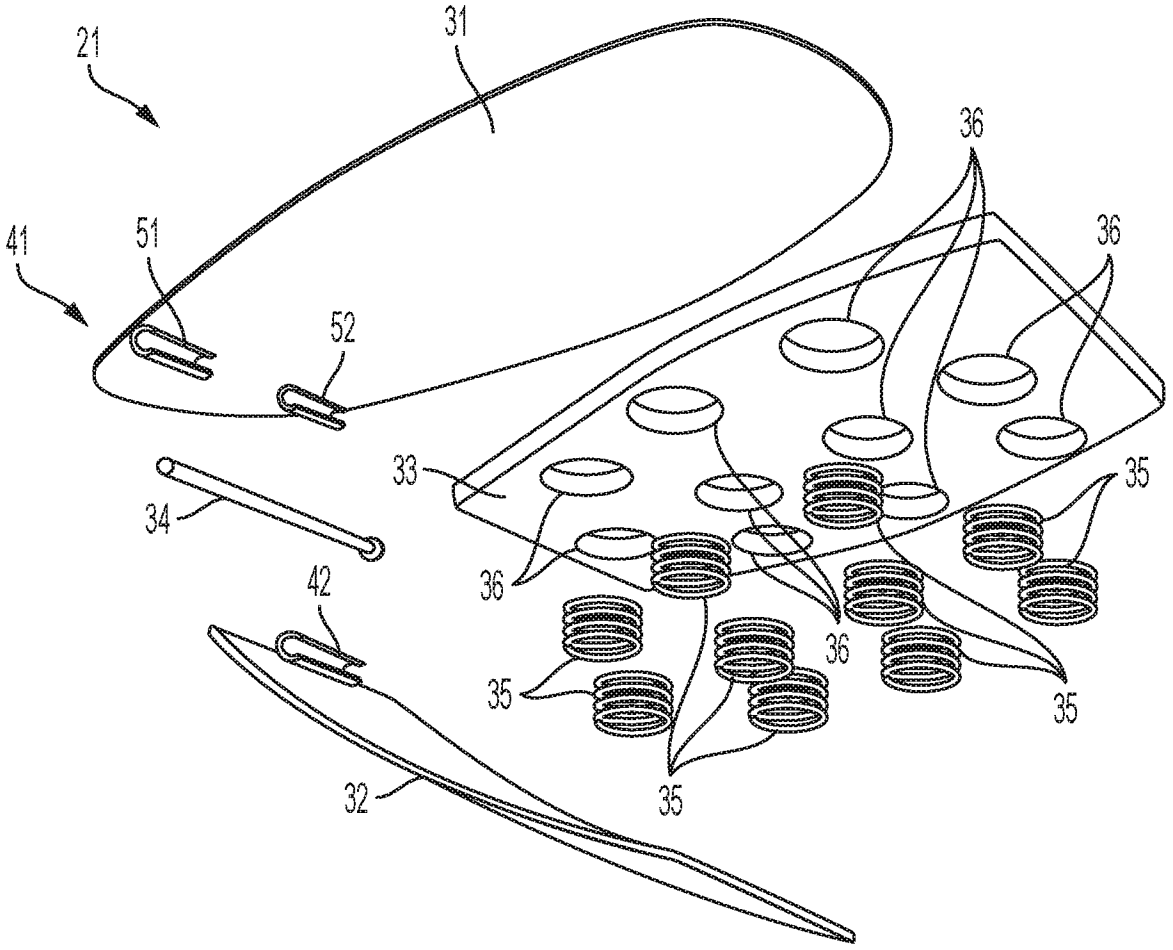
FIG. 4 shows an exploded view of a device for use in a shoe in accordance with an embodiment.

FIG. 4 shows an exploded view of the device 21 in accordance with an embodiment. The device 21 includes the first plate 31, the second plate 32, the filler material 33, the pin 34, and the springs 35. Each of the springs 35 is inserted into a corresponding one of the openings 36 in the filler material 33. The first plate 31 has the hinge portion 41. The hinge portion 41 of the first plate 31 includes a first portion 51 and a second portion 52. The first portion 51 of the hinge portion 41 of the first plate 31 is spaced apart from the second portion 52 of the hinge portion 41 of the first plate 31, such that the hinge portion 42 of the second plate 32 is able to fit between the first portion 51 of the hinge portion 41 of the first plate 31 and the second portion 52 of the hinge portion 41 of the first plate 31. The pin 34 can be inserted through the first portion 51 of the hinge portion 41 of the first plate 31, the hinge portion 42 of the second plate 32, and the second portion 52 of the hinge portion 41 of the first plate 31 when they are aligned such that the first plate 31 is hingedly connected to the second plate 32. In the embodiment shown, the first portion 51 of the hinge portion 41 of the first plate 31 and the second portion 52 of the hinge portion 41 of the first plate 31 are located forward from a back end of the first plate 31, whereas the hinge portion 42 of the second plate 32 is located at a back end of the second plate 32 such that a back end of the first plate 31 extends farther back than a back end of the second plate 32 when they are hinged together.

Figure 5:
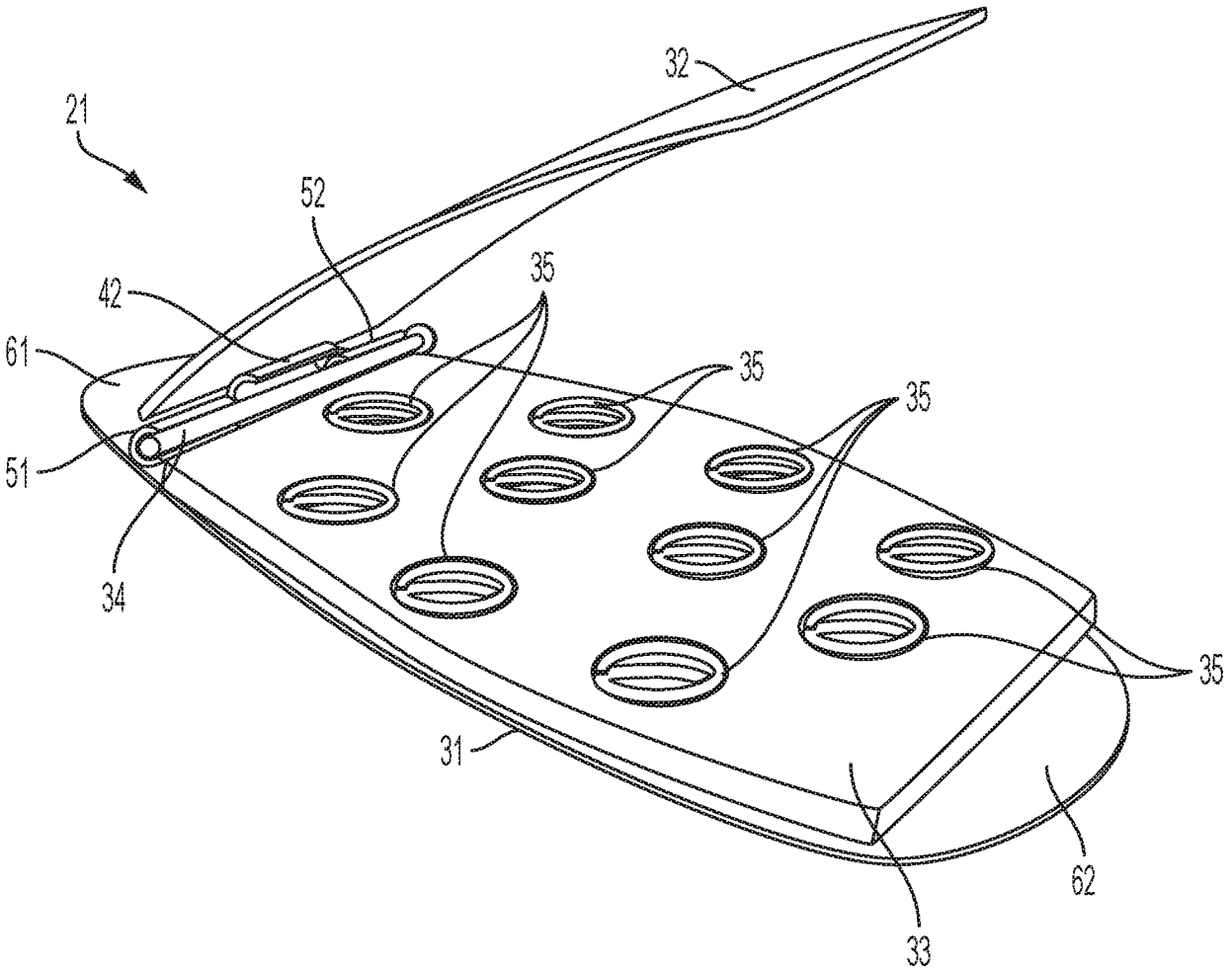
FIG. 5 shows an upside-down view of the device of FIG. 4 for use in a shoe in accordance with an embodiment.

FIG. 5 shows an upside-down view of the device 21 of FIG. 4 in accordance with an embodiment. The device 21 includes the first plate 31, the second plate 32, the filler material 33, the pin 34, and the springs 35. With reference to FIGS. 4 and 5, each of the springs 35 is shown is FIG. 5 as inserted into a corresponding one of the openings 36 in the filler material 33. The first plate 31 has the hinge portion 41. The hinge portion 41 of the first plate 31 includes the first portion 51 and the second portion 52. The first portion 51 and the second portion 52 are located forward of a back end of the first plate 31 such that there is a back portion 61 of the first plate 31 that is a bottom surface of the first plate 31 between the first and second portions 51 and 52 and the back end of the first plate 31. In various embodiments, the second plate 32 and the filler material 33 are shorter in length than the first plate 31 such that there is a front portion 62 of the first plate 31 that is a bottom surface of the first plate 31 that extends farther forward than a front end of the second plate 32 and a front end of the filler material 33. With reference to FIGS. 4 and 5, the pin 34 can be inserted through the first portion 51 of the hinge portion 41 of the first plate 31, the hinge portion 42 of the second plate 32, and the second portion 52 of the hinge portion 41 of the first plate 31 when they are aligned as shown in FIG. 5 such that the first plate 31 is hingedly connected to the second plate 32.

Figure 6A:
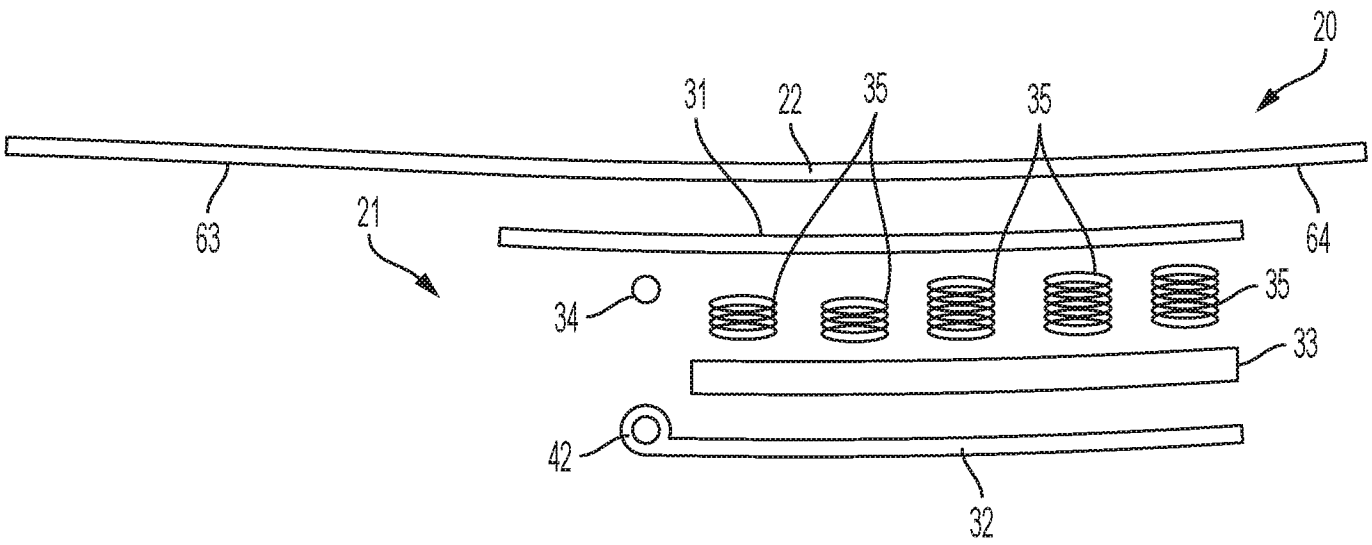
FIG. 6A shows an exploded side view of the device from FIG. 2 for use in a shoe in accordance with an embodiment.

FIG. 6A shows an exploded side view of the device 20 from FIG. 2 for use in a shoe in accordance with an embodiment. The device 20 includes the device 21 and the plate 22. The device 21 includes the first plate 31, the second plate 32, the filler material 33, the pin 34, and the springs 35. In the embodiment shown in FIG. 6A, the hinge portion 42 of the second plate 32 extends to a side edge of the second plate 32 and the first plate 31 can have a hinge portion on an opposite side edge of the first plate 31 that aligns with the hinge portion 42 of the second plate 32. As shown in FIG. 6A, the plate 22 is longer than the first plate 31 such that a back portion 63 of the plate 22 extends farther back than a back end of the first plate 31 and such that a front portion 64 of the plate 22 extends farther forward than a front end of the first plate 31.

Figure 6B:
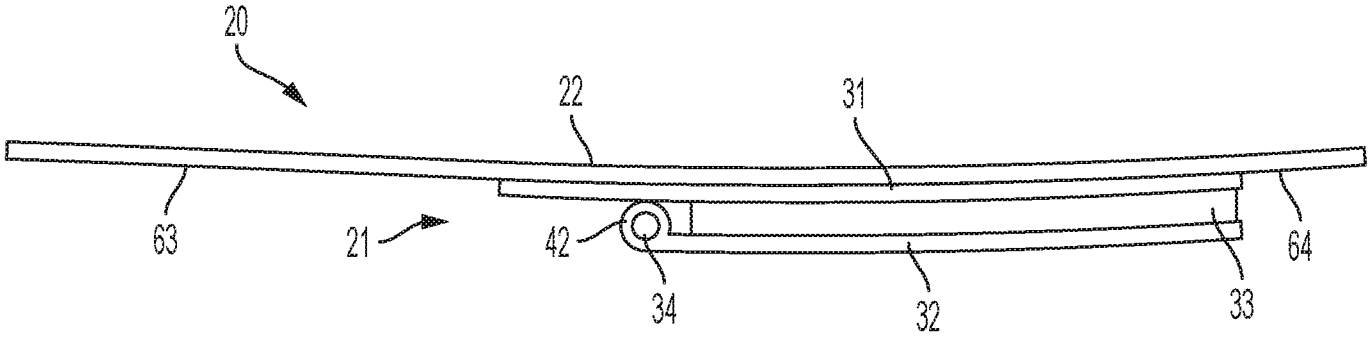
FIG. 6B shows a side view of the device from FIG. 6A in an assembled state for use in a shoe in accordance with an embodiment.

FIG. 6B shows a side view of the device 20 from FIG. 6A in an assembled state for use in a shoe in accordance with an embodiment. The device 20 includes the device 21 and the plate 22. The device 21 includes the first plate 31, the second plate 32, the filler material 33, and the pin 34. The springs 35 shown in FIG. 6A are located within openings in the filler material 33 and are thus not visible in the assembled side view of FIG. 6B. The pin 34 extends through the hinge portion 42 of the second plate 32.

The plate 22 is glued or otherwise affixed to the first plate 31. For example, an entire top surface of the first plate 31 in various embodiments is glued to a bottom surface of the plate 22. In various embodiments, the plate 22 is a carbon fiber plate and the first plate 31 is a polyether block amide plate, and the first plate 31 is glued to the plate 22. In various embodiments, the plate 22 is affixed, such as being permanently affixed, to the device 21 such that the plate 22 works together with the device 21 to provide energy return to a user using a shoe in which the device 20 is located. In various embodiments, the plate 22 is affixed to the first plate 31 of the device 21 such that an energy return of the plate 22 works with a kinetic release of the device 21 when a user is using the shoe. As shown in FIG. 6B, the plate 22 is longer than the first plate 31 such that the back portion 63 of the plate 22 extends farther back than a back end of the first plate 31 and such that the front portion 64 of the plate 22 extends farther forward than a front end of the first plate 31.

Figure 7A:
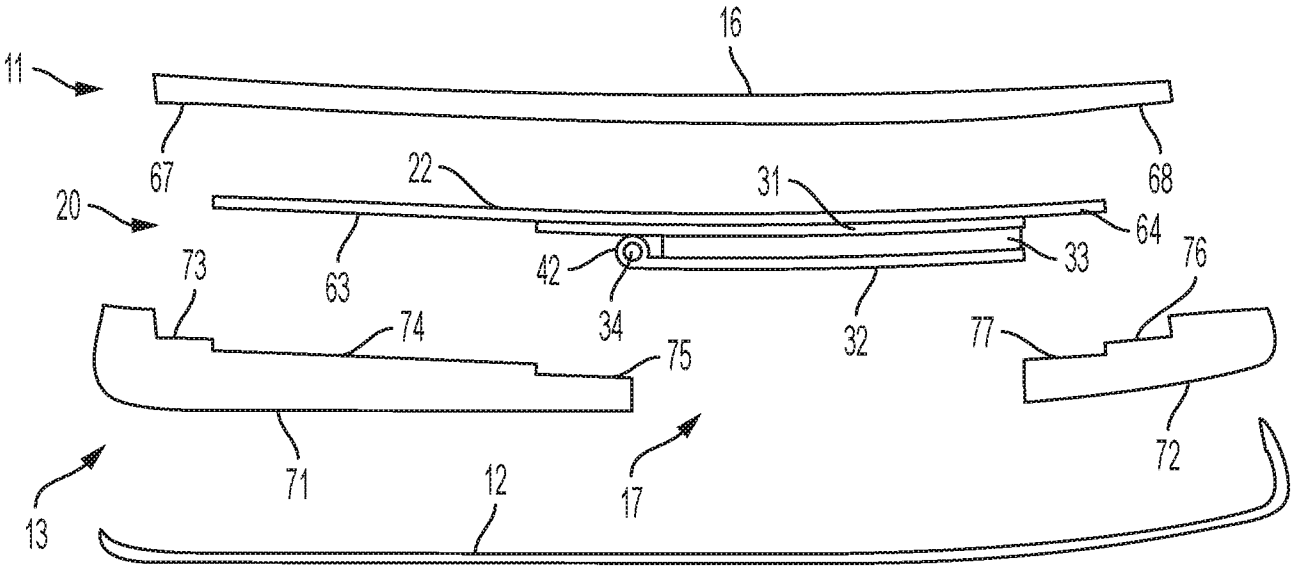
FIG. 7A shows an exploded side view of an inner part of a shoe with the device from FIG. 6A in accordance with an embodiment.

FIG. 7A shows an exploded side view of an inner part of the shoe 11 with the device 20 from FIG. 6A in accordance with an embodiment. The shoe 11 includes the outsole 12, the midsole 13, the insole 16, and the device 20. There is the opening 17 in the midsole 13 into which a portion of the device 20 is positionable. The device 20 includes the plate 22, the first plate 31, the second plate 32, the filler material 33, and the pin 34. The springs 35 (refer to FIG. 6A) are positioned within openings in the filler material 33 and are thus not visible in FIG. 7A. The second plate 32 has the hinge portion 42. The plate 22 is glued or otherwise affixed to a top surface of the first plate 31. The back portion 63 of the plate 22 extends farther back in the shoe 11 than a back end of the first plate 31. The front portion 64 of the plate 22 extends farther forward in the shoe 11 than a front end of the first plate 31.

The insole 16 is located above the plate 22 in the shoe 11. The insole 16 is longer than the plate 22 such that a back portion 67 of the insole 16 extends farther back in the shoe 11 than a back end of the plate 22 and such that a front portion 68 of the insole 16 extends farther forward in the shoe 11 than a front end of the plate 22. The midsole 13 includes a back portion 71 of the midsole 13 that is located farther back in the shoe 11 than the opening 17 in the midsole 13, and the midsole 13 also includes a front portion 72 of the midsole 13 that is located farther forward in the shoe 11 than the opening 17 in the midsole 13. The back portion 71 of the midsole 13 includes a first surface 73 of the back portion 71 of the midsole 13, a second surface 74 of the back portion 71 of the midsole 13, and a third surface 75 of the back portion 71 of the midsole 13. The front portion 72 of the midsole 13 includes a first surface 76 of the front portion 72 of the midsole 13 and a second surface 77 of the front portion 72 of the midsole 13.

The first surface 73 of the back portion 71 of the midsole 13 is higher in the shoe 11 than the second surface 74 of the back portion 71 of the midsole 13 such that there is a step down from the first surface 73 of the back portion 71 of the midsole 13 to the second surface 74 of the back portion 71 of the midsole 13. The second surface 74 of the back portion 71 of the midsole 13 is higher in the shoe 11 than the third surface 75 of the back portion 71 of the midsole 13 such that there is a step down from the second surface 74 of the back portion 71 of the midsole 13 to the third surface 75 of the back portion 71 of the midsole 13. The first surface 76 of the front portion 72 of the midsole 13 is higher in the shoe 11 than the second surface 77 of the front portion 72 of the midsole 13 such that there is a step down from the first surface 76 of the front portion 72 of the midsole 13 to the second surface 77 of the front portion 72 of the midsole 13.

The back portion 67 of the insole 16 is positionable on the first surface 73 of the back portion 71 of the midsole 13. The back portion 63 of the plate 22 is positionable on the second surface 74 of the back portion 71 of the midsole 13. A back portion of the first plate 31 is positionable on the third surface 75 of the back portion 71 of the midsole 13. The front portion 68 of the insole 16 is positionable on the first surface 76 of the front portion 72 of the midsole 13. The front portion 64 of the plate 22 is positionable on the second surface 77 of the front portion 72 of the midsole 13. The second plate 32 and the filler material 33 are positionable within the opening 17 in the midsole 13.

Figure 7B:
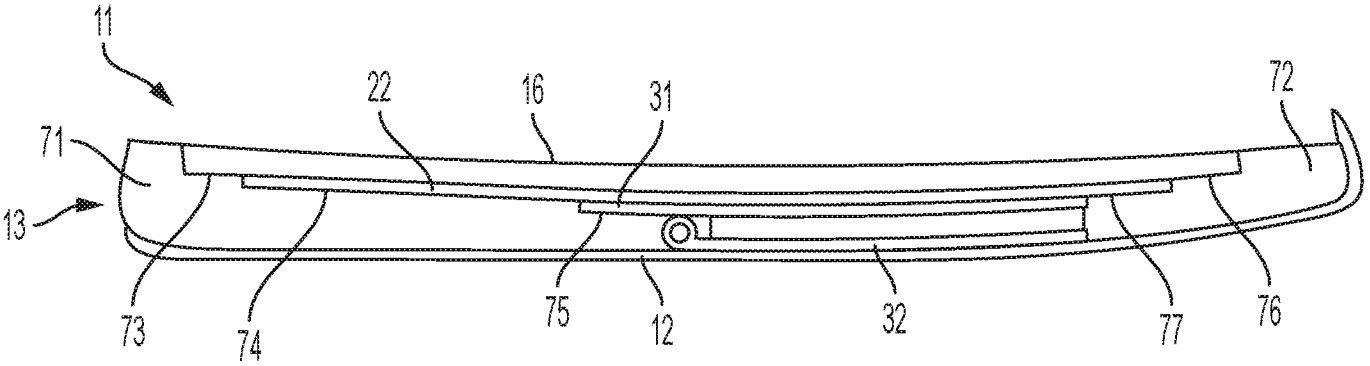
FIG. 7B shows a side view of an inner part of the shoe with the device from FIG. 7A in an assembled state in accordance with an embodiment.

FIG. 7B shows a side view of the inner part of the shoe 11 with the device 20 from FIG. 7A in an assembled state in accordance with an embodiment. The back portion 71 of the midsole 13 and the front portion 72 of the midsole 13 are located on the outsole 12. The second plate 32 is located on the outsole 12 and within an opening in the midsole 13. The back portion of the insole 16 is located on the first surface 73 of the back portion 71 of the midsole 13. The back portion of the plate 22 is located on the second surface 74 of the back portion 71 of the midsole 13. The back portion of the first plate 31 is located on the third surface 75 of the back portion 71 of the midsole 13. The front portion of the insole 16 is located on the first surface 76 of the front portion 72 of the midsole 13. The front portion of the plate 22 is located on the second surface 77 of the front portion 72 of the midsole 13. The insole 16 is located on the plate 22. The plate 22 is glued or otherwise affixed to a top surface of the first plate 31. The first plate 31 is hingedly connected to the second plate 32.

With reference to FIGS. 2, 3, and 7B, a method in accordance with an embodiment allows for storing and returning energy during a propulsion phase of a gait cycle in a human step using the device 20 in the shoe 11. The springs 35 bias the first plate 31 and the second plate 32 apart from each other. In various embodiments, the method comprises applying, with a foot, a force on the plate 22 that is affixed to the first plate 31 so as to cause the first plate 31 to move or rotate toward the second plate 32 and increase a loading of the springs 35. The method further includes launching the foot due to the first plate 31 and the second plate 32 being moved apart by the springs 35 causing the plate 22 attached to the first plate 31 to return energy to the foot as the foot is being lifted. The energy return of the plate 22 works with the kinetic release of the device 21 to return energy to the foot. In various embodiments, the plate 22 is permanently affixed to the first plate 31.

Figure 13:
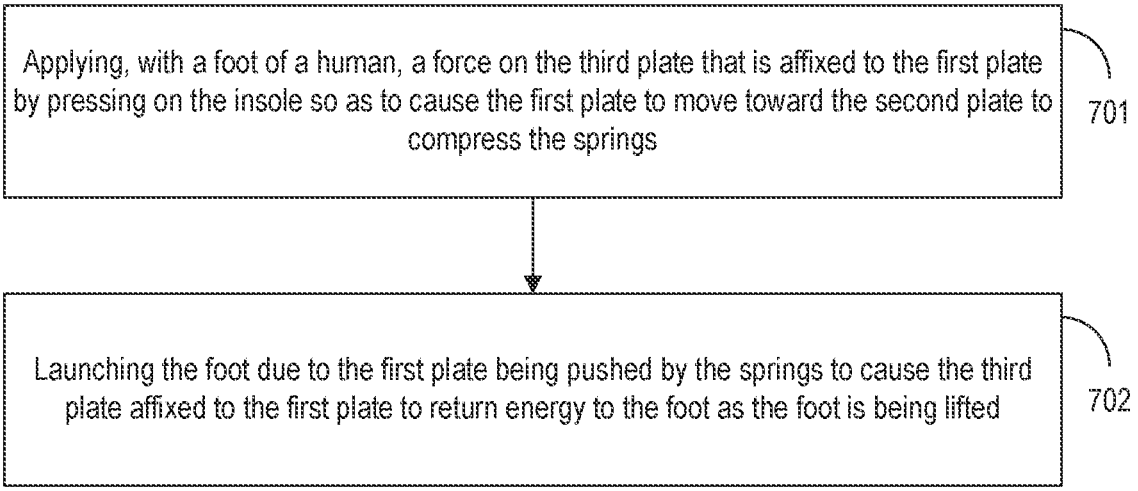
FIG. 13 is a flowchart of a method in accordance with an embodiment using, for example, the shoe of FIG. 2.

FIG. 13 is a flowchart of a method in accordance with an embodiment using, for example, the shoe 11 of FIG. 2. With reference to FIGS. 2, 3, and 13, the method allows for storing and returning energy to a foot of a human by the shoe 11. In step 701, the method includes applying, with the foot, a force on a third plate such as the plate 22 that is affixed to the first plate 31 by pressing on the insole 16 so as to cause the first plate 31 to move toward the second plate 32 to compress the springs 35. In step 702, the method includes launching the foot due to the first plate 31 being pushed by the springs 35 to cause the third plate such as the plate 22 affixed to the first plate 31 to return energy to the foot as the foot is being lifted.

Figure 8:
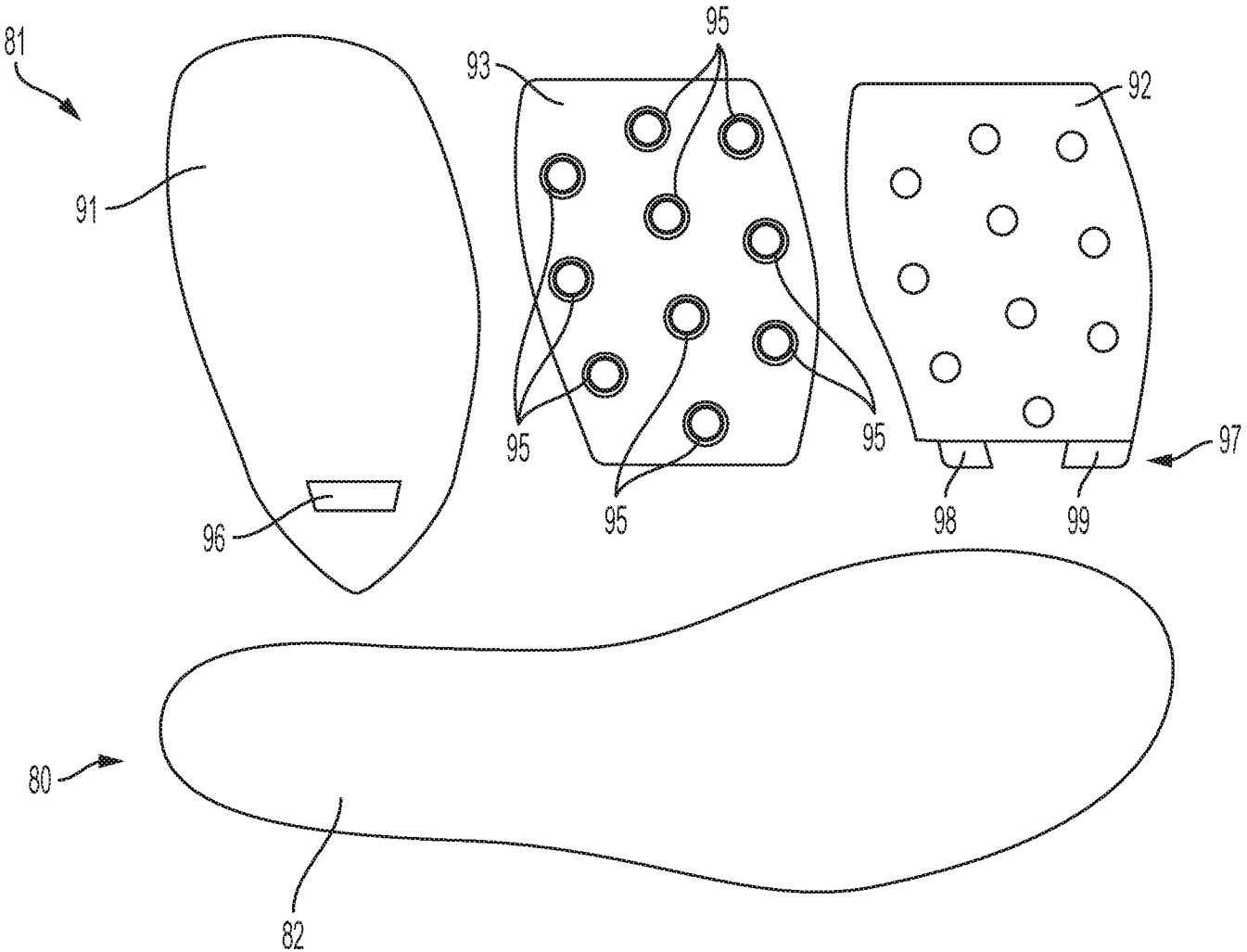
FIG. 8 shows a device for use in a shoe in accordance with an embodiment.

FIG. 8 shows a device 80 for use in a shoe in accordance with an embodiment. The device 80 includes a device 81 and a plate 82. In various embodiments, the plate 82 is a carbon fiber plate, or the like. The device 81 includes a first plate 91, a second plate 92, filler material 93, and springs 95. The springs 95 are positioned in openings in the filler material 93. The first plate 91 includes a hinge portion 96 of the first plate 91. The second plate 92 includes a hinge portion 97 of the second plate 92. The hinge portion 97 of the second plate 92 includes a first portion 98 of the hinge portion 97 of the second plate 92 and a second portion 99 of the hinge portion 97 of the second plate 92.

A method of manufacturing the device 80 includes placing the filler material 93 and the springs 95 between the first plate 91 and the second plate 92, and aligning the hinge portion 96 of the first plate 91 between the first portion 98 of the hinge portion 97 of the second plate 92 and the second portion 99 of the hinge portion 97 of the second plate 92. Then a pin can be placed through the first portion 98 of the hinge portion 97 of the second plate 92, the hinge portion 96 of the first plate 91, and the second portion 99 of the hinge portion 97 of the second plate 92 such that the first plate 91 is hingedly connected to the second plate 92. Then, the plate 82 is glued or otherwise affixed to a top surface of the first plate 91. In various embodiments, the plate 82 is a carbon fiber plate or the like, and the first plate 91 is a thermoplastic elastomer plate such as a polyether block amide (PEBA) plate made of the PEBA material known as Pebax® or the like. In various embodiments, the device 80 has a size such that it has a length that is greater than at least half of a length of a shoe into which the device 80 is located. The plate 82 has a length that is greater than a length of the first plate 91.

Figure 9:
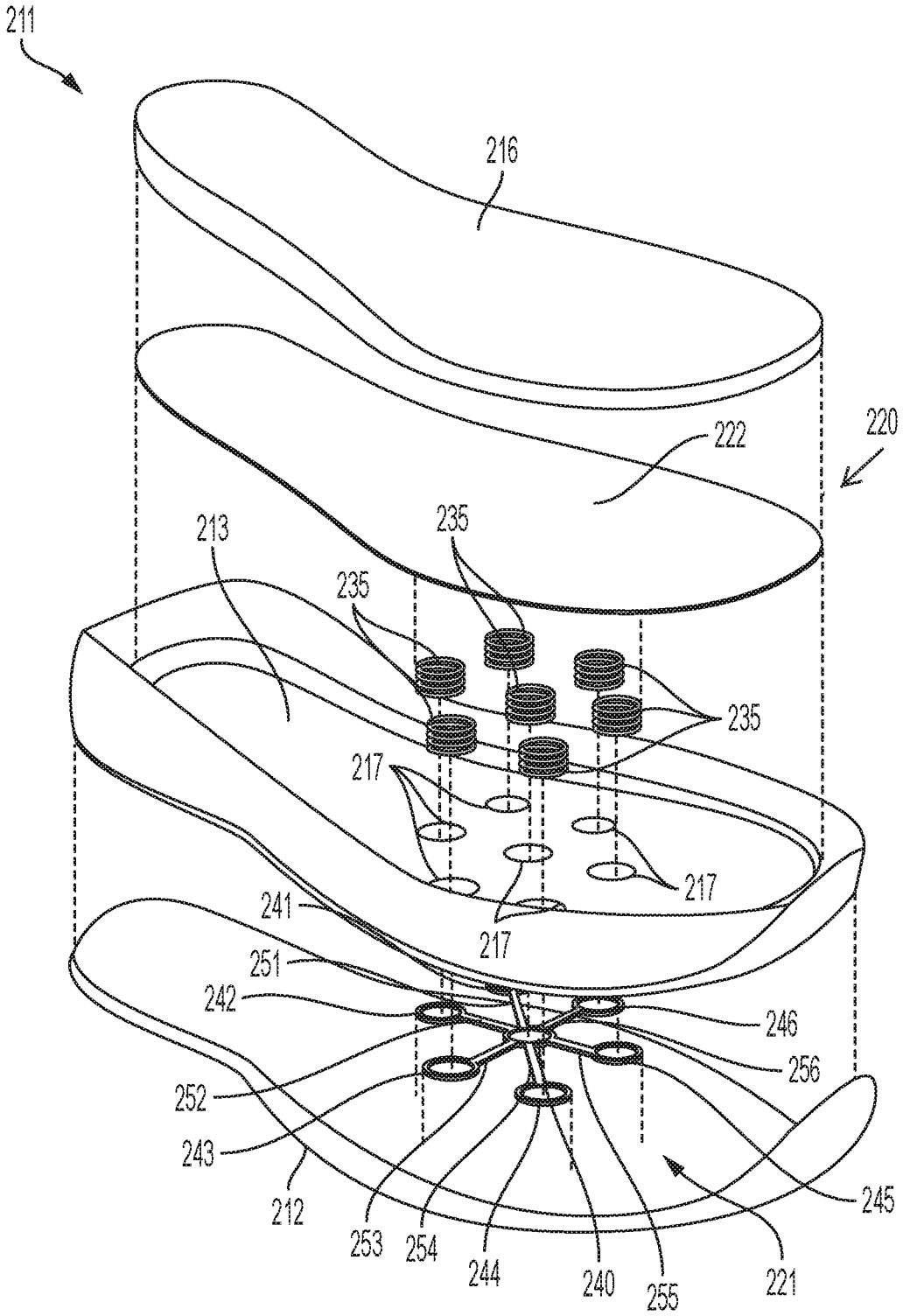
FIG. 9 shows an exploded view of a portion of a shoe including a device in accordance with an embodiment.

FIG. 9 shows an exploded view of a shoe 211 in accordance with an embodiment. The shoe 211 includes an outsole 212, a midsole 213, an insole 216, and a device 220. The device 220 includes a plate 222, a spring holding unit 221, and springs 235. The spring holding unit 221 has a tree shape with spring holding members 240, 241, 242, 243, 244, 245, and 246 and branches 251, 252, 253, 254, 255, and 256 connecting corresponding spring holding members. Each of the spring holding members 240, 241, 242, 243, 244, 245, and 246 is configured to hold a corresponding one of the springs 235. In various embodiments, a width of each of the branches 251, 252, 253, 254, 255, and 256 is smaller than a diameter of each of the corresponding ones of the spring holding members 240, 241, 242, 243, 244, 245, and 246 to which the branch is connected. There are openings 217 in the midsole 213 that pass from a top surface to a bottom surface of the midsole 213. The spring holding unit 221 is positioned under the midsole 213 and between the midsole 213 and the outsole 212. Each of the springs 235 is positionable within a corresponding one of the openings 217 in the midsole 213 to be held by a corresponding one of the spring holding members 240, 241, 242, 243, 244, 245, and 246.

The insole 216 is located above the plate 222. The plate 222 is located above the midsole 213 and the springs 235. Though not shown in FIG. 9, the shoe 211 can have other elements such as an upper and a fastening member similar to the upper 14 and the fastening member 15 of the shoe 11 in FIG. 1. Referring to FIGS. 1 and 9, the shoe 211 also has a forefoot portion, ball portion, arch portion, and heel portion in a longitudinal direction as shown for the shoe 11 of FIG. 1. In various embodiments, the plate 222 is a carbon fiber plate or the like. Also, in various embodiments, the plate 222 has a same or similar shape as the insole 216 in length and width directions. In various embodiments, the plate 222 extends across substantially an entire length of the shoe 211. For example, in some embodiments, the plate 222 extends within an area bounded by a wall of the midsole 213 at the back of the shoe 211 to a wall of the midsole 213 at the front of the shoe 211. In various embodiments, the plate 222 extends from a heel portion of the shoe 211 and through an arch portion and ball portion of the shoe 211 and into a forefoot portion of the shoe 211. In some embodiments, the plate 222 is shorter in length than the insole 216. In some embodiments, there is a sockliner positioned above the insole 216 that is on an opposite side of the insole 216 from the plate 222. In various embodiments, the insole 216 comprises an ethylene-vinyl acetate (EVA) material, or the like.

The spring holding unit 221 shown in FIG. 9 is one type of a clip layout for holding the springs 235. Other types of layouts for the spring holding unit 221 can be used. FIGS. 12A, 12B, 12C, 12D, 12E, 12F, 12G, 12H, 12I, and 12J show various layouts for spring holding units that could be used in place of the spring holding unit 221 of FIG. 9 in various embodiments. The openings 217 in the midsole 213 would be in a pattern to match the layout of the spring holding unit 221 such that the springs 235 positioned in the openings 217 of the midsole 213 would align with the spring holding members of the selected spring holding unit. In the spring holding unit 221 of FIG. 9, the spring holding member 240 is connected to the spring holding member 241 by the branch 251, the spring holding member 240 is connected to the spring holding member 242 by the branch 252, the spring holding member 240 is connected to the spring holding member 243 by the branch 253, the spring holding member 240 is connected to the spring holding member 244 by the branch 254, the spring holding member 240 is connected to the spring holding member 245 by the branch 255, and the spring holding member 240 is connected to the spring holding member 246 by the branch 256.

In various embodiments, the spring holding unit 221 holds at least bottom portions of the springs 235. Materials used for the spring holding unit 221 can be determined based on settings desired for sport, comfort, or the like. For example, the spring holding unit 221 could be made of one or more of a polycarbonate, styrene, thermoplastic polyurethane (TPU), a thermoplastic elastomer such as Pebax®, poly-paraphenylene terephthalamide known as Kevlar, carbon fiber, and/or the like. In some embodiments, the branches 251, 252, 253, 254, 255, and 256 are made of a material to be firm. In some embodiments, the branches 251, 252, 253, 254, 255, and 256 are made of a material to allow for flexing of the branches 251, 252, 253, 254, 255, and 256, which may provide for greater energy return to a foot of a user. In various embodiments, the branches 251, 252, 253, 254, 255, and 256 are straight. In some embodiments, the branches 251, 252, 253, 254, 255, and 256 are wavy. In some embodiments, the branches 251, 252, 253, 254, 255, and 256 are configured to be able to flex together as a unit. In some embodiments, the branches 251, 252, 253, 254, 255, and 256 are configured to be independently flexible from each other.

In some embodiment, the spring holding unit 221 is formed of a material to provide for energy return in addition to the energy return provided by the springs 235. In some embodiments, the spring holding unit 221 is formed of a material that substantially does not provide for energy return such that the energy return is provided mainly by the springs 235 by the device 220. In various embodiments, the branches 251, 252, 253, 254, 255, and 256 are formed of a material to allow them to move independently to allow for flexing of the branches 251, 252, 253, 254, 255, and 256 when stepping on uneven surfaces. In various embodiments, the branches 251, 252, 253, 254, 255, and 256 are configured such that the device 220 has a uniformity of compression and release. In various embodiments, the spring holding unit 221 is configured such that the springs 235 compress uniformly. In some embodiments, the spring holding unit 221 is configured such that the springs 235 do not compress uniformly. The desired compression can depend on what terrain the shoe 211 is designed for, such as for off-road running the spring holding unit 221 can be configured to have the springs 235 operate as independent shock absorbers. This would allow for articulation of the spring holding unit 221 with a runner as they take steps. In various embodiments, the spring holding unit 221 is positioned in a forefoot portion and a ball portion of the shoe 211. In some embodiments, the spring holding unit 221 further extends into an arch portion of the shoe 211. In some embodiments, the spring holding unit 221 further extends into a heel portion of the shoe 211.

Figure 10:
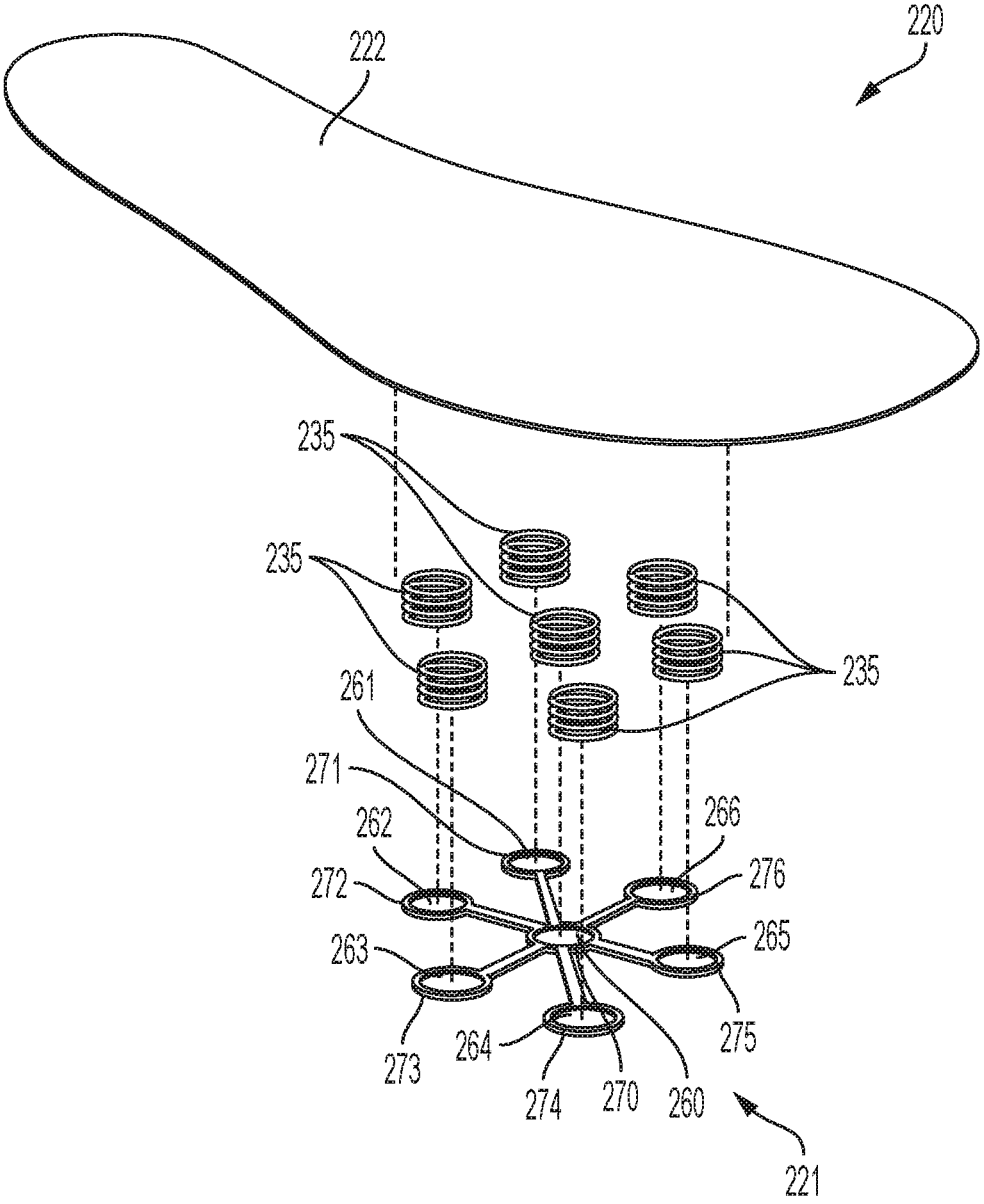
FIG. 10 shows an exploded view of the device from FIG. 9 for use in a shoe in accordance with an embodiment.

FIG. 10 shows an exploded view of the device 220 from FIG. 9 for use in a shoe in accordance with an embodiment. The device 220 includes the plate 222, the spring holding unit 221, and the springs 235. With reference to FIGS. 9 and 10, each of the spring holding members 240, 241, 242, 243, 244, 245, and 246 includes a surface on which a corresponding one of the springs 235 can sit, and includes a wall around the surface to surround at least a portion of the corresponding one of the springs 235 when it is sitting on the spring holding member. For example, the spring holding member 240 includes a surface 260 on which a corresponding one of the springs 235 can sit, and also includes a wall 270 for surrounding at least a portion of the one of the springs 235 when it sits on the surface 260.

Similarly, the spring holding member 241 includes a surface 261 on which a corresponding one of the springs 235 can sit, and also includes a wall 271 for surrounding at least a portion of the one of the springs 235 when it sits on the surface 261. The spring holding member 242 includes a surface 262 on which a corresponding one of the springs 235 can sit, and also includes a wall 272 for surrounding at least a portion of the one of the springs 235 when it sits on the surface 262. The spring holding member 243 includes a surface 263 on which a corresponding one of the springs 235 can sit, and also includes a wall 273 for surrounding at least a portion of the one of the springs 235 when it sits on the surface 263. The spring holding member 244 includes a surface 264 on which a corresponding one of the springs 235 can sit, and also includes a wall 274 for surrounding at least a portion of the one of the springs 235 when it sits on the surface 264. The spring holding member 245 includes a surface 265 on which a corresponding one of the springs 235 can sit, and also includes a wall 275 for surrounding at least a portion of the one of the springs 235 when it sits on the surface 265. The spring holding member 246 includes a surface 266 on which a corresponding one of the springs 235 can sit, and also includes a wall 276 for surrounding at least a portion of the one of the springs 235 when it sits on the surface 266.

Figure 11A:
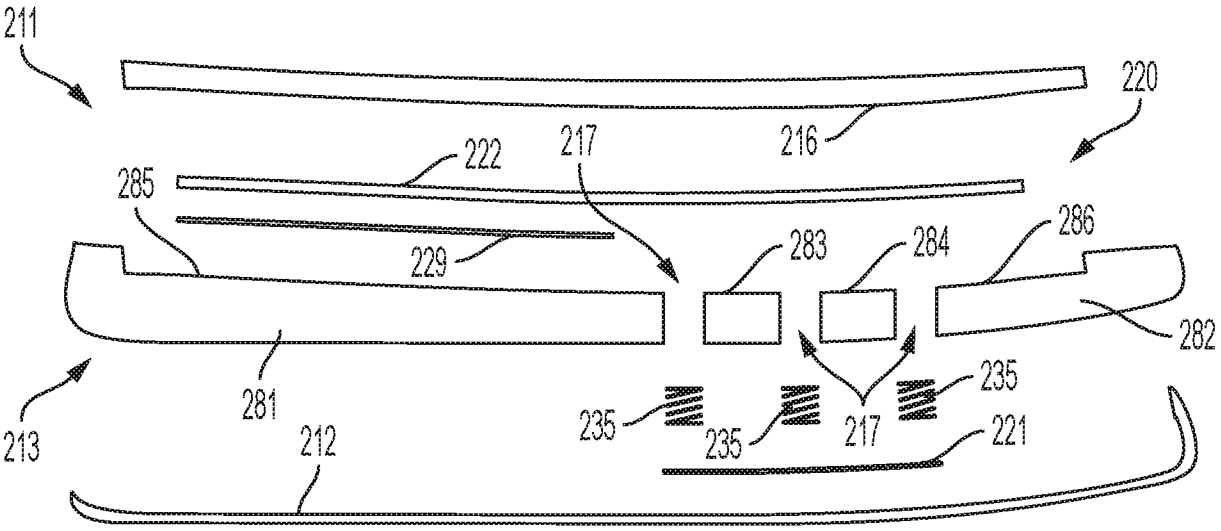
FIG. 11A shows an exploded side view of an inner part of the shoe with the device from FIG. 9 in accordance with an embodiment.

FIG. 11A shows an exploded side view of an inner part of the shoe 211 with the device 220 from FIG. 9 in accordance with an embodiment. The shoe 211 includes the outsole 212, the midsole 213, the insole 216, and the device 220. The device 220 includes the plate 222, the spring holding unit 221, and the springs 235. In some embodiments, the device 220 further includes a plate 229. There are openings 217 in the midsole 213 that pass from a top surface to a bottom surface of the midsole 213. The midsole 213 has a back portion 281, a middle portion 283, a middle portion 284, and a front portion 282. The back portion 281 of the midsole 213 has a top surface 285. The front portion 282 of the midsole 213 has a top surface 286. The spring holding unit 221 is positioned under the midsole 213 and between the midsole 213 and the outsole 212. Each of the springs 235 is positionable within a corresponding one of the openings 217 in the midsole 213 to be held by the spring holding unit 221.

The insole 216 is located above the plate 222. The plate 222 is located above the midsole 213 and the springs 235. In various embodiments, such as in FIG. 11A, the insole 216 is longer than the plate 222 such that a front portion of the insole 216 extends farther forward in the shoe 211 than a front end of the plate 222 and such that a back portion of the insole 216 extends farther back in the shoe 211 than a back end of the plate 222. The plate 229 is located above the back portion 281 of the midsole 213, and is between the midsole 213 and the plate 222. In various embodiments, the plate 222 is a carbon fiber plate or the like.

Figure 11B:
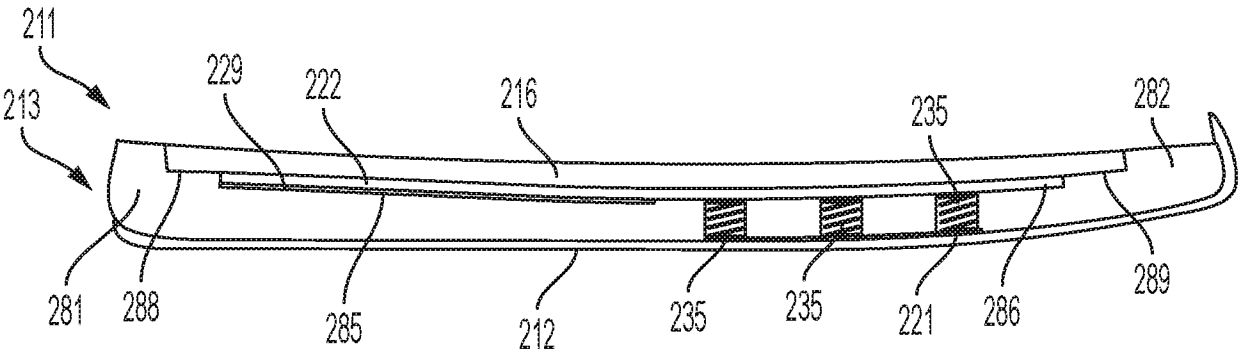
FIG. 11B shows a side view of an inner part of the shoe with the device from FIG. 11A in an assembled state in accordance with an embodiment.

FIG. 11B shows a side view of an inner part of the shoe 211 with the device 220 from FIG. 11A in an assembled state in accordance with an embodiment. With reference to FIG. 11B, the spring holding unit 221 is located on the outsole 212. The springs 235 are located on the spring holding unit 221 and extend through openings in the midsole 213. The plate 229 is located on the top surface 285 of the back portion 281 of the midsole 213. In some embodiments, the back portion 281 of the midsole 213 further includes a top surface 288 that is higher than the top surface 285, and a back portion of the insole 216 is located on the top surface 288. The plate 222 is under the insole 216 and extends from on top of the plate 229 and over the springs 235 to over the top surface 286 of the front portion 282 of the midsole 213. In some embodiments, the front portion 282 of the midsole 213 further includes a top surface 289 that is higher than the top surface 286, and a front portion of the insole 216 is located on the top surface 289. In various embodiments, when a user wears the shoe 211 and presses down with a foot to move the plate 222 downward, the plate 222 compresses the springs 235 that are held by the spring holding unit 221, and then the springs 235 can return energy to the foot of the user.

FIGS. 12A, 12B, 12C, 12D, 12E, 12F, 12G, 12H, 12I, and 12J show layouts for spring holding units or clips in accordance with various embodiments that could be used in place of the spring holding unit 221 shown in FIG. 9. The spring holding unit 221 in FIG. 9 includes seven spring holding members. In various other embodiments, different numbers of spring holding members can be used, such as 2, 3, 4, 5, 6, 8, 9, 10, or more than 10 spring holding members. The number of springs used could change to match the number of spring holding members. In various embodiments, such as the embodiments shown, each of the spring holding members includes a surface on which a spring can be placed and a wall for holding at least a portion of a spring. In various embodiments, such as the embodiments shown, a width of each of the branches is smaller than a diameter of each of the corresponding ones of the spring holding members to which the branch is connected.

Figure 12B:
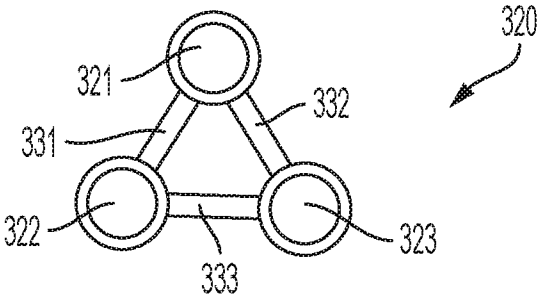
FIGS. 12A, 12B, 12C, 12D, 12E, 12F, 12G, 12H, 12I, and 12J show layouts for spring holding units in accordance with various embodiments that could be used in place of the spring holding unit shown in FIG. 9.
Figure 12D:
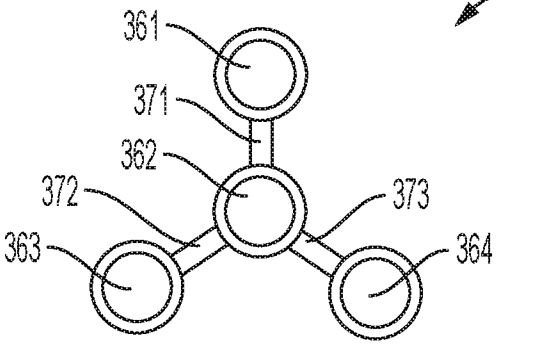
Figure 12A:
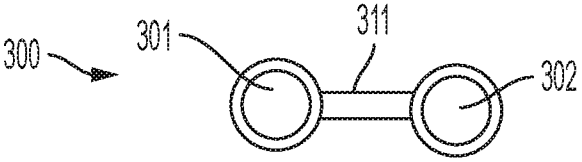
Figure 12C:
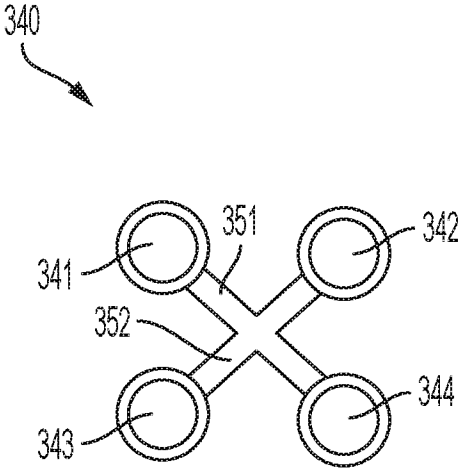

FIG. 12A shows a spring holding unit 300 including spring holding members 301 and 302 that are connected by branch 311. FIG. 12B shows a spring holding unit 320 including spring holding members 321, 322, and 323, and branches 331, 332, and 333. Spring holding members 321 and 322 are connected by branch 331. Spring holding members 321 and 323 are connected by branch 332. Spring holding members 322 and 323 are connected by branch 333. FIG. 12C shows a spring holding unit 340 including spring holding members 341, 342, 343, and 344, and branches 351 and 352. Spring holding members 341 and 344 are connected by branch 351. Spring holding members 342 and 343 are connected by branch 352. The branch 351 is connected to the branch 352 at a center of the spring holding unit 340. FIG. 12D shows a spring holding unit 360 including spring holding members 361, 362, 363, and 364, and branches 371, 372, and 373. Spring holding members 361 and 362 are connected by branch 371. Spring holding members 362 and 363 are connected by branch 372. Spring holding members 362 and 364 are connected by branch 373.

Figure 12F:
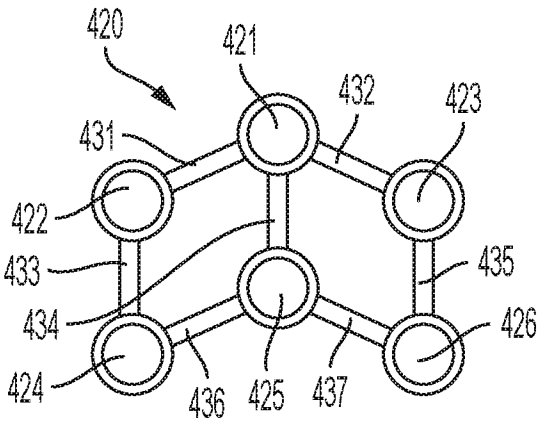
Figure 12E:
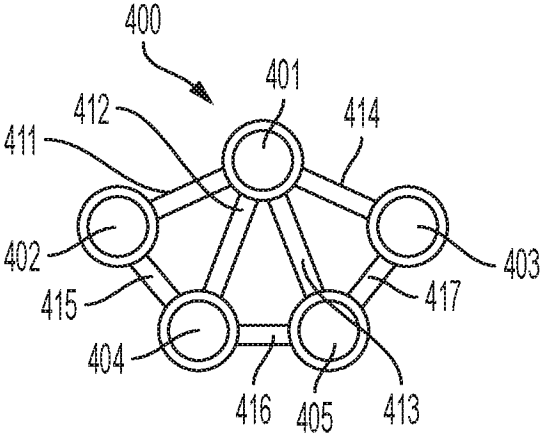

FIG. 12E shows a spring holding unit 400 including spring holding members 401, 402, 403, 404, and 405, and branches 411, 412, 413, 414, 415, 416, and 417. Spring holding members 401 and 402 are connected by branch 411. Spring holding members 401 and 404 are connected by branch 412. Spring holding members 401 and 405 are connected by branch 413. Spring holding members 401 and 403 are connected by branch 414. Spring holding members 402 and 404 are connected by branch 415. Spring holding members 404 and 405 are connected by branch 416. Spring holding members 405 and 403 are connected by branch 417.

FIG. 12F shows a spring holding unit 420 including spring holding members 421, 422, 423, 424, 425, and 426, and branches 431, 432, 433, 434, 435, 436, and 437. Spring holding members 421 and 422 are connected by branch 431. Spring holding members 421 and 423 are connected by branch 432. Spring holding members 422 and 424 are connected by branch 433. Spring holding members 421 and 425 are connected by branch 434. Spring holding members 423 and 426 are connected by branch 435. Spring holding members 424 and 425 are connected by branch 436. Spring holding members 425 and 426 are connected by branch 437.

Figure 12G:
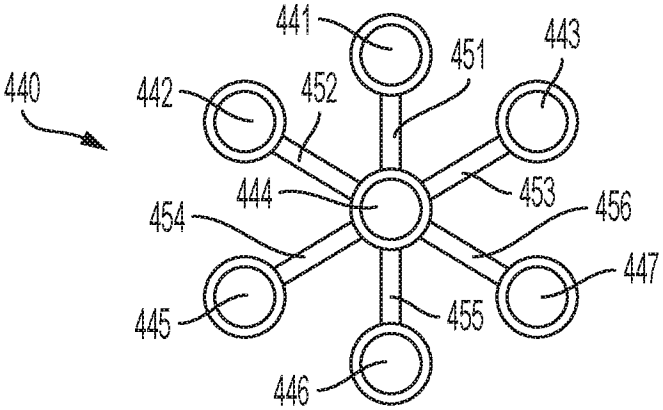

FIG. 12G shows a spring holding unit 440 including spring holding members 441, 442, 443, 444, 445, 446, and 447, and branches 451, 452, 453, 454, 455, and 456. Spring holding members 441 and 444 are connected by branch 451. Spring holding members 442 and 444 are connected by branch 452. Spring holding members 443 and 444 are connected by branch 453. Spring holding members 445 and 444 are connected by branch 454. Spring holding members 446 and 444 are connected by branch 455. Spring holding members 447 and 444 are connected by branch 456.

Figure 12I:
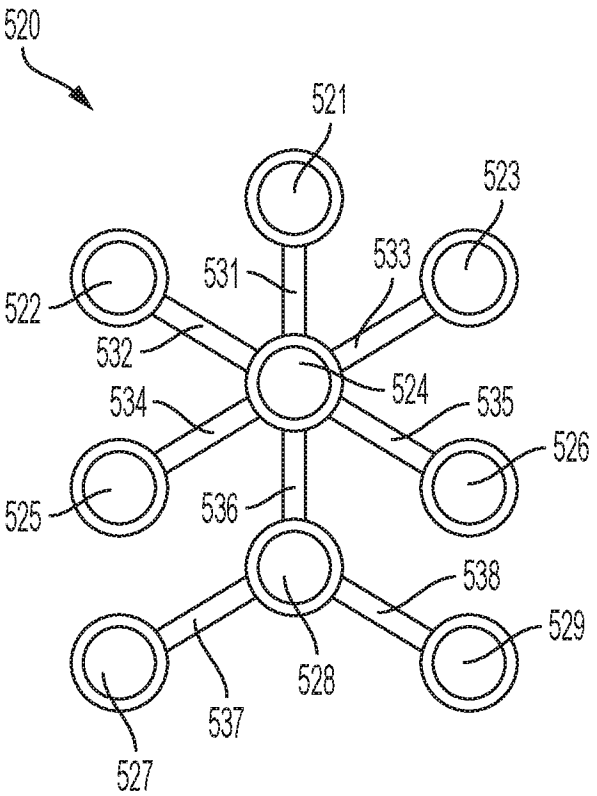
Figure 12H:
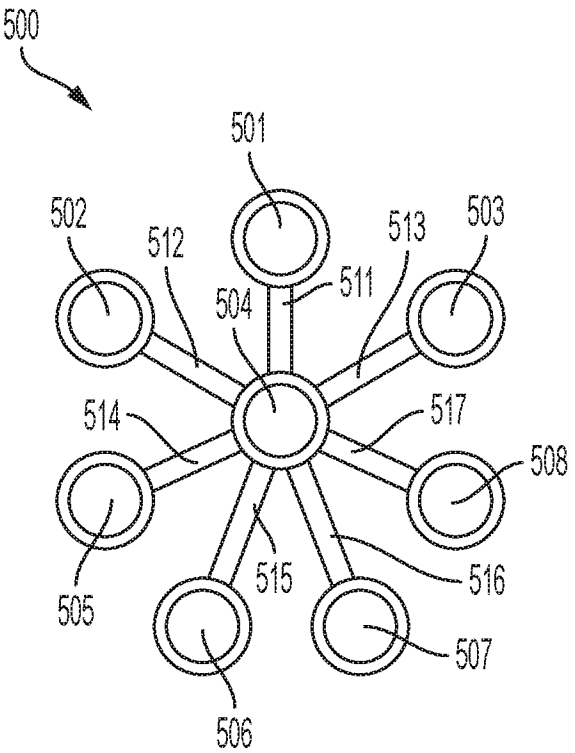

FIG. 12H shows a spring holding unit 500 including spring holding members 501, 502, 503, 504, 505, 506, 507, and 508, and branches 511, 512, 513, 514, 515, 516, and 517. Spring holding members 504 and 501 are connected by branch 511. Spring holding members 504 and 502 are connected by branch 512. Spring holding members 504 and 503 are connected by branch 513. Spring holding members 504 and 505 are connected by branch 514. Spring holding members 504 and 506 are connected by branch 515. Spring holding members 504 and 507 are connected by branch 516. Spring holding members 504 and 508 are connected by branch 517.

FIG. 12I shows a spring holding unit 520 including spring holding members 521, 522, 523, 524, 525, 526, 527, 528, and 529, and branches 531, 532, 533, 534, 535, 536, 537, and 538. Spring holding members 521 and 524 are connected by branch 531. Spring holding members 522 and 524 are connected by branch 532. Spring holding members 523 and 524 are connected by branch 533. Spring holding members 524 and 525 are connected by branch 534. Spring holding members 524 and 526 are connected by branch 535. Spring holding members 524 and 528 are connected by branch 536. Spring holding members 527 and 528 are connected by branch 537. Spring holding members 528 and 529 are connected by branch 538.

Figure 12J:
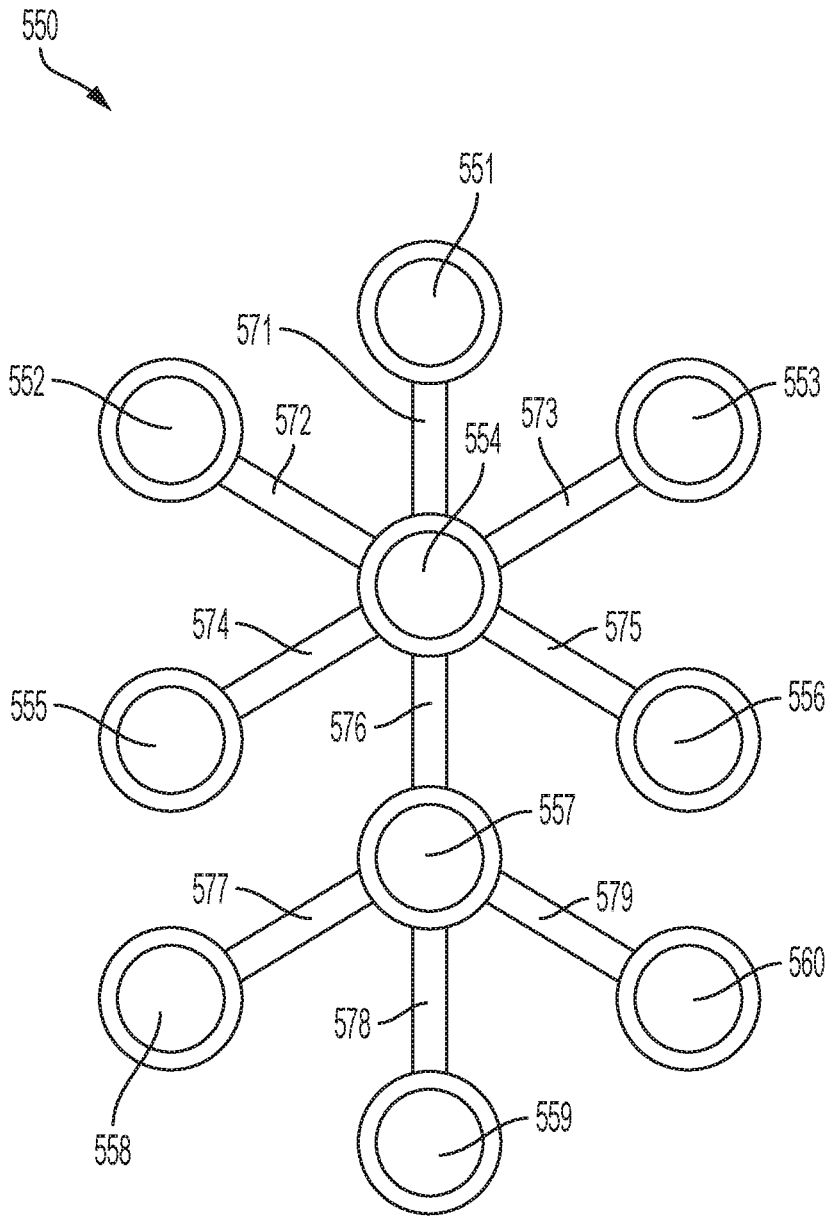

FIG. 12J shows a spring holding unit 550 including spring holding members 551, 552, 553, 554, 555, 556, 557, 558, 559, and 560, and branches 571, 572, 573, 574, 575, 576, 577, 578, and 579. Spring holding members 551 and 554 are connected by branch 571. Spring holding members 552 and 554 are connected by branch 572. Spring holding members 553 and 554 are connected by branch 573. Spring holding members 554 and 555 are connected by branch 574. Spring holding members 554 and 556 are connected by branch 575. Spring holding members 554 and 557 are connected by branch 576. Spring holding members 557 and 558 are connected by branch 577. Spring holding members 557 and 559 are connected by branch 578. Spring holding members 557 and 560 are connected by branch 579.

With reference to FIGS. 9, 12A, 12B, 12C, 12D, 12E, 12F, 12G, 12H, 12I, and 12J, any of the spring holding units 300, 320, 340, 360, 400, 420, 440, 500, 520, and 550 could be substituted for the spring holding unit 221 in the shoe 211 with the number of springs 235 changed to match the number of spring holding members of the spring holding unit that is used in the shoe 211.

Figure 14A:
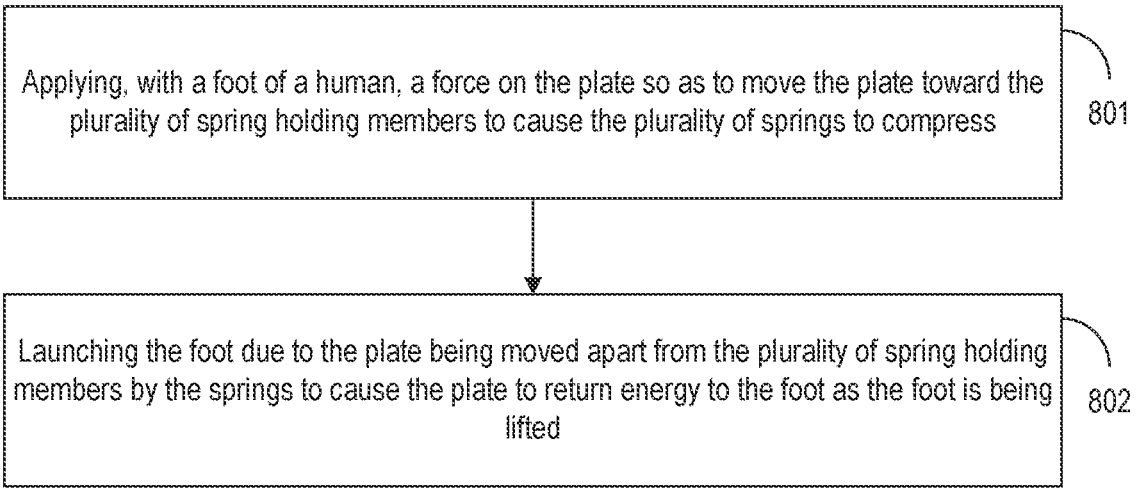
FIG. 14A is a flowchart of a method in accordance with an embodiment using, for example, the shoe of FIG. 9.

FIG. 14A is a flowchart of a method in accordance with an embodiment using, for example, the shoe 211 of FIG. 9. With reference to FIGS. 9 and 14A, the method allows for storing and returning energy to a foot of a human by the shoe 211. In step 801, the method includes applying, with the foot, a force on the plate 222 so as to move the plate 222 toward the plurality of spring holding members 240, 241, 242, 243, 244, 245, and 246 to cause the plurality of springs 235 to compress. In step 802, the method includes launching the foot due to the plate 222 being moved apart from the plurality of spring holding members 240, 241, 242, 243, 244, 245, and 246 by the springs 235 to cause the plate 222 to return energy to the foot as the foot is being lifted.

Figure 14B:
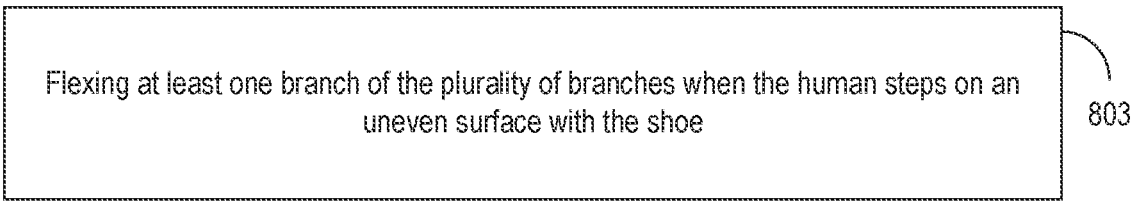
FIG. 14B is a method step in accordance with an embodiment that can be used with the method shown in FIG. 14A.

FIG. 14B is a method step in accordance with an embodiment that can be used with the method shown in FIG. 14A. In step 803, the method includes flexing at least one branch of the plurality of branches 251, 252, 253, 254, 255, and 256 when the human steps on an uneven surface with the shoe 211.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention.

What is claimed is:

1. A shoe, comprising:

a first plate and a second plate that are hingedly connected to each other;

a third plate affixed to a top surface of the first plate;

an insole located on a top surface of the third plate; and a midsole;

wherein the second plate is located within an opening in the midsole;

wherein a back portion of the first plate is located on a top surface of the midsole and the top surface of the midsole on which the back portion of the first plate is located is higher in the shoe than a bottom surface of the second plate and the top surface of the midsole on which the back portion of the first plate is located is adjacent to the opening in the midsole;

wherein the first plate is longer than the second plate such that the first plate extends farther back in the shoe than the second plate;

wherein the first plate includes a hinge portion that extends from a bottom surface of the first plate and within the opening in the midsole;

wherein the third plate comprises carbon fiber; and wherein the third plate is longer than the first plate and is positioned such that a back portion of the third plate extends farther back than a back end of the first plate and such that a front portion of the third plate extends farther forward than a front end of the first plate.

2. The shoe of claim 1, wherein the first plate comprises a thermoplastic elastomer.

3. The shoe of claim 2, wherein the insole comprises an ethylene-vinyl acetate material.

4. The shoe of claim 1, wherein the first plate comprises titanium.

5. The shoe of claim 1, wherein the third plate has a shorter length than a length of the insole.

6. The shoe of claim 1, wherein the third plate extends within an area bounded by a first wall of the midsole at a back of the shoe to a second wall of the midsole at a front of the shoe.

7. The shoe of claim 1, wherein the first plate extends farther forward in the shoe than the second plate.

8. The shoe of claim 1, wherein the third plate is glued to the first plate.

9. The shoe of claim 1, wherein an entirety of the top surface of the first plate is glued to a bottom surface of the third plate.

10. The shoe of claim 1, wherein the hinge portion of the first plate is integrally formed with the bottom surface of the first plate.

11. The shoe of claim 10, wherein the hinge portion of the first plate extends from the bottom surface of the first plate at a location that is positioned a certain distance inward from the back end of the first plate.

12. The shoe of claim 11, wherein a hinge portion of the second plate extends from a back end of the second plate and is integrally formed with the back end of the second plate; and wherein a pin extends through the hinge portion of the first plate and the hinge portion of the second plate.

13. The shoe of claim 10, wherein the hinge portion of the first plate extends from the bottom surface of the first plate at a location that is positioned more than one centimeter inward from the back end of the first plate.

14. The shoe of claim 1, further comprising:

filler material located between the first plate and the second plate; and springs located within openings in the filler material;

wherein the second plate and the filler material are shorter in length than a length of the first plate such that there is a front portion of the first plate that extends farther forward than a front end of the second plate and a front end of the filler material.

15. The shoe of claim 1, wherein the midsole includes a back portion of the midsole that is located farther back in the shoe than the opening in the midsole, and the midsole also includes a front portion of the midsole that is located farther forward in the shoe than the opening in the midsole.

16. The shoe of claim 15, wherein the back portion of the midsole includes a first surface of the back portion of the midsole, a second surface of the back portion of the midsole, and a third surface of the back portion of the midsole;

wherein the front portion of the midsole includes a first surface of the front portion of the midsole and a second surface of the front portion of the midsole;

wherein the first surface of the back portion of the midsole is higher in the shoe than the second surface of the back portion of the midsole such that there is a step down from the first surface of the back portion of the midsole to the second surface of the back portion of the midsole;

wherein the second surface of the back portion of the midsole is higher in the shoe than the third surface of the back portion of the midsole such that there is a step down from the second surface of the back portion of the midsole to the third surface of the back portion of the midsole; and wherein the first surface of the front portion of the midsole is higher in the shoe than the second surface of the front portion of the midsole such that there is a step down from the first surface of the front portion of the midsole to the second surface of the front portion of the midsole.

17. The shoe of claim 16, wherein the back portion of the midsole and the front portion of the midsole are located on an outsole;

wherein the second plate is located on the outsole and within the opening in the midsole;

wherein a back portion of the insole is located on the first surface of the back portion of the midsole;

wherein the back portion of the third plate is located on the second surface of the back portion of the midsole;

wherein the back portion of the first plate is located on the third surface of the back portion of the midsole;

wherein a front portion of the insole is located on the first surface of the front portion of the midsole; and wherein the front portion of the third plate is located on the second surface of the front portion of the midsole.

18. The shoe of claim 1, wherein the opening in the midsole goes entirely through the midsole from a top of the midsole to a bottom of the midsole.

19. The shoe of claim 18, further comprising:

an outsole;

wherein the midsole is positioned on the outsole; and wherein the second plate is located directly on the outsole.

20. The shoe of claim 1, wherein the back portion of the first plate is located directly on the top surface of the midsole.

21. The shoe of claim 1, wherein the hinge portion of the first plate is integrally formed with the bottom surface of the first plate;

wherein the hinge portion of the first plate extends from the bottom surface of the first plate at a location that is positioned a certain distance inward from the back end of the first plate; and wherein a pin extends through the hinge portion of the first plate.

22. The shoe of claim 1, wherein a pin extends through the hinge portion of the first plate and a hinge portion of the second plate; and wherein the pin is located within the opening in the midsole.

23. The shoe of claim 22, wherein the pin is located lower in the shoe than the back portion of the first plate that is located on the top surface of the midsole.

24. The shoe of claim 1, wherein the front end of the first plate is located within the opening in the midsole.

25. The shoe of claim 1, wherein the back end of the of the first plate is located outside of the opening in the midsole.

26. The shoe of claim 1, wherein the front end of the first plate is located within the opening in the midsole; and wherein the back end of the of the first plate is located outside of the opening in the midsole.

27. The shoe of claim 1, wherein the second plate has a size such that the second plate fits entirely within the opening in the midsole; and wherein the first plate is longer than the second plate such that a particular portion of the first plate is located within the opening in the midsole and the back portion of the first plate is located outside of the opening in the midsole.

28. A method for storing and returning energy to a foot of a human by a shoe, the shoe including a first plate and a second plate that are hingedly connected to each other, springs located between the first plate and the second plate, a third plate affixed to a top surface of the first plate, a midsole, and an insole located on a top surface of the third plate, wherein the second plate is located within an opening in the midsole, wherein a back portion of the first plate is located on a top surface of the midsole, wherein the top surface of the midsole on which the back portion of the first plate is located is higher in the shoe than a bottom surface of the second plate, wherein the top surface of the midsole on which the back portion of the first plate is located is adjacent to the opening in the midsole, wherein the first plate is longer than the second plate such that the first plate extends farther back in the shoe than the second plate, wherein the first plate includes a hinge portion that extends from a bottom surface of the first plate and within the opening in the midsole, and wherein the third plate is longer than the first plate and is positioned such that a back portion of the third plate extends farther back than a back end of the first plate and such that a front portion of the third plate extends farther forward than a front end of the first plate, the method comprising:

applying, with the foot, a force on the third plate that is affixed to the first plate by pressing on the insole so as to cause the first plate to move toward the second plate to compress the springs; and launching the foot due to the first plate being pushed by the springs to cause the third plate affixed to the first plate to return energy to the foot as the foot is being lifted;

wherein the third plate comprises carbon fiber.

29. The method of claim 28, wherein the first plate comprises a thermoplastic elastomer.

30. The method of claim 29, wherein the third plate is glued to the first plate.

* * * * *